US010249130B2

(12) United States Patent
Sasaki et al.

(10) Patent No.: US 10,249,130 B2
(45) Date of Patent: Apr. 2, 2019

(54) GAME MACHINE PROVIDED WITH LOTTERY MECHANISM

(71) Applicant: Konami Digital Entertainment Co., Ltd., Minato-ku, Tokyo (JP)

(72) Inventors: Ryu Sasaki, Minato-ku (JP); Takashi Sakuma, Minato-ku (JP); Kensaku Yoshida, Minato-ku (JP); Yoshihiro Ando, Minato-ku (JP)

(73) Assignee: KONAMI DIGITAL ENTERTAINMENT CO., LTD., Tokyo (JP)

( * ) Notice: Subject to any disclaimer, the term of this patent is extended or adjusted under 35 U.S.C. 154(b) by 259 days.

(21) Appl. No.: 15/443,654

(22) Filed: Feb. 27, 2017

(65) Prior Publication Data

US 2017/0178445 A1 Jun. 22, 2017

Related U.S. Application Data

(63) Continuation of application No. PCT/JP2015/072663, filed on Aug. 10, 2015.

(30) Foreign Application Priority Data

Sep. 18, 2014 (JP) ..... 2014-190597

(51) Int. Cl.
*G07F 17/32* (2006.01)

(52) U.S. Cl.
CPC ..... *G07F 17/3213* (2013.01); *G07F 17/329* (2013.01); *G07F 17/3216* (2013.01); *G07F 17/3225* (2013.01)

(58) Field of Classification Search
USPC ..... 463/17
See application file for complete search history.

(56) References Cited

U.S. PATENT DOCUMENTS

2006/0019735 A1* 1/2006 Toyoda ..... A63F 3/06 463/17
2006/0163806 A1* 7/2006 Toyoda ..... A63F 3/0645 273/142 R

FOREIGN PATENT DOCUMENTS

JP 2012-005766 A 1/2012

OTHER PUBLICATIONS

Written Opinion (English and Japanese), International Application No. PCT/JP2015/072663, dated Sep. 1, 2015.

(Continued)

*Primary Examiner* — Pierre E Elisca
(74) *Attorney, Agent, or Firm* — Howard & Howard Attorneys PLLC

(57) ABSTRACT

A game machine comprises a physical lottery mechanism including a plurality of lottery portions, wherein an image display device having a transmissive screen through which each lottery portion can be seen is arranged on each of the front and back of the lottery mechanism; games different from each other are simultaneously performed so as to make a difference between a lottery portion to be used in a game for one side of the lottery mechanism and a lottery portion to be used in a game for the other side of the lottery mechanism, and display of the image display device is controlled so that a lottery state of a lottery portion being used in a game is seen through the transmissive region of the screen, while a lottery state of a lottery portion not being used in the game is less visible or invisible in the game.

9 Claims, 17 Drawing Sheets

(56) References Cited

OTHER PUBLICATIONS

International Search Report (English and Japanese), International Application No. PCT/JP2015/072663, dated Sep. 1, 2015.
Written Opinion (English and Japanese), International Application No. PCT/JP2015/072663, dated Sep. 9, 2015.
Decision to Grant a Patent (English and Japanese), Patent Application No. 2014-190597, Date of Drafting: Mar. 24, 2015.

* cited by examiner

FIG. 17

| | | |
|---|---|---|
| Lottery Game A | Sequential Type | Middle Lottery Portion<br>Small Lottery Portion |
| Lottery Game B | Single Type | Large Lottery Portion |
| Lottery Game C | Simultaneous Type | Large Lottery Portion<br>Middle Lottery Portion<br>Small Lottery Portion |

⋮

FIG. 18

Lottery Game A (Middle Lottery Portion)

| | |
|---|---|
| Pocket#1 | 30 |
| Pocket#2 | 50 |
| Pocket#3 | NEXT |

⋮

(Small Lottery Portion)

| | |
|---|---|
| Pocket#1 | 100 |
| Pocket#2 | 0 |
| Pocket#3 | JackPot |

⋮

GAME MACHINE PROVIDED WITH LOTTERY MECHANISM

CROSS-REFERENCE TO RELATED APPLICATION

This application is a continuation of PCT Application No. PCT/JP2015/072663, filed Aug. 10, 2015, which claims priority to Japanese Patent Application No. 2014-190597, filed Sep. 18, 2014, the disclosures of which are hereby incorporated by reference in their entirety.

FIELD OF INVENTION

The present invention relates to a game machine providing a game where a lottery by a physical lottery mechanism is used.

BACKGROUND ART

There is known to be a game machine which comprises a plurality of terminal portions where a plurality of users play games respectively and a physical lottery mechanism shared by the terminal portions (for example patent literature #1)

CITATION LIST

Patent Literature

PTL #1: JP2012-5766 A.

SUMMARY OF INVENTION

Technical Problem

In a conventional game machine, in a case that a lottery game using the lottery mechanism starts for one of the users as a lottery right holder, even if the other user gets the other lottery right, it is disable to start another lottery game for the next user until the lottery game which has already started ends. Due to this, there is a possibility that a user having the lottery right has to wait for an excessively long time until start of his/her lottery.

In consideration of the above, the present invention aims to provide a game machine which is capable of providing to a plurality of users, games different from each other with using a shared physical lottery mechanism.

Solution to Problem

One aspect of the present invention is a game machine comprising: a lottery mechanism having has at least one lottery portion in which a lottery is performed using physical motion of a game medium, the lottery mechanism being provided so that a state of the lottery is observed from each of a plurality of game providing areas, a plurality of image display devices, each of the plurality of image display devices including a screen which is arranged between each of the plurality of game providing areas and the lottery mechanism and has a transmission region through which the at least one lottery portion is seen; and being allowed to display image on the screen so that the image is superposed on at least a part of the at least one lottery portion, a game control device which is programmed to execute simultaneously games in association with the lottery with respect to the plurality of the game providing areas respectively, the game being different from each other; and a display control device which is programmed to make each of the image display devices display image appropriate to the game to be executed with respect to each of the game providing areas.

BRIEF DESCRIPTION OF DRAWINGS

FIG. 17 is a diagram showing one example of one part of lottery game information;

FIG. 18 is a diagram exemplifying the other part of the lottery game information.

DETAILED DESCRIPTION OF THE INVENTION

Figure 1:
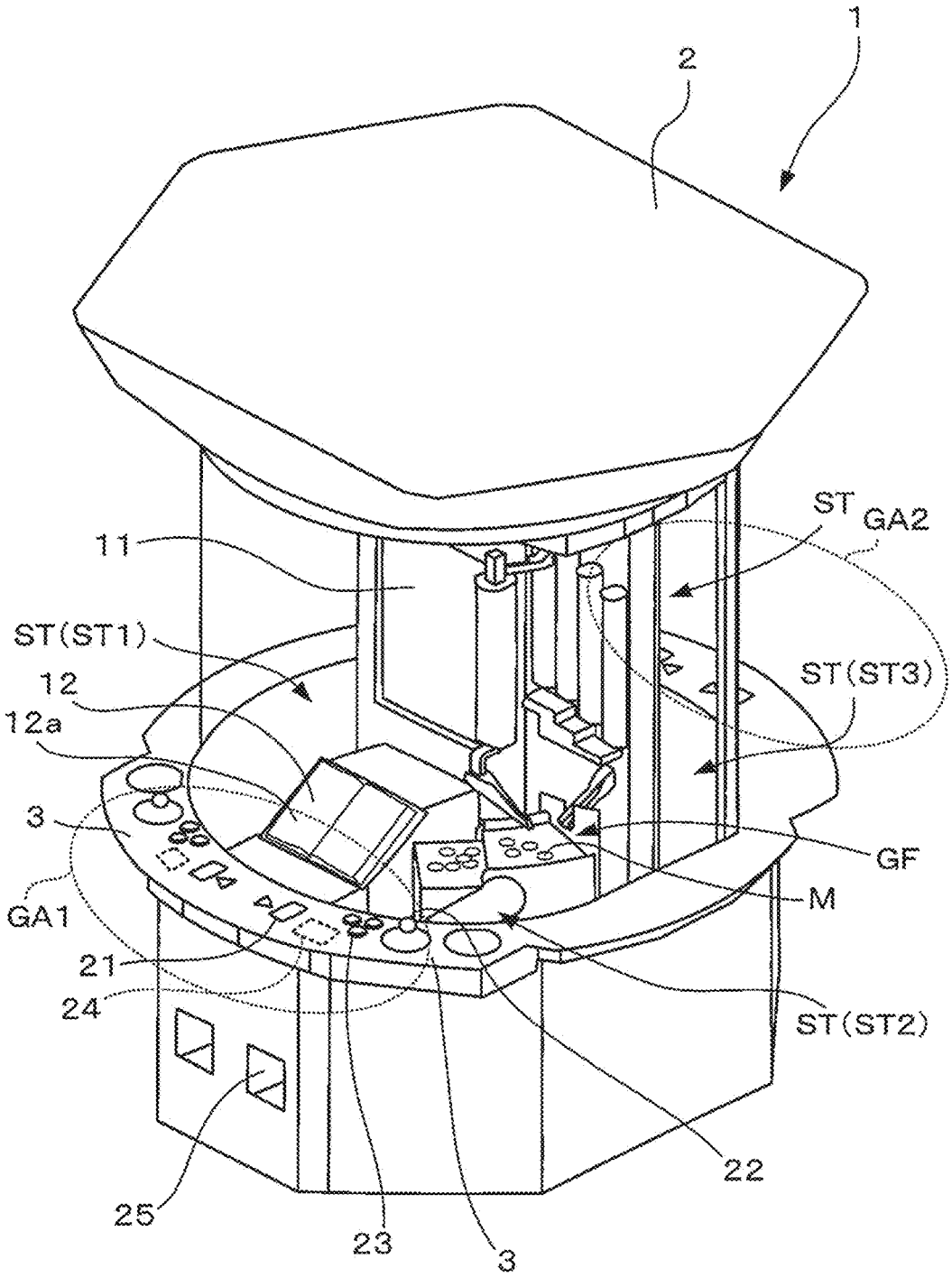
FIG. 1 is an oblique perspective view of a game machine according to one aspect of the present invention.

FIG. 1 is an overall view of a game machine 2 according to one embodiment of a game machine as one aspect of the present invention. The game machine 2 functions, by connecting with a not-illustrated game server via a network, as a terminal apparatus in a game system 1. The game server provides various kinds of service to the game machine 2. However, since the function for providing the various kinds of service is not directly related to the subject of the present invention, the following will be described mainly about the game machine 2. The game machine 2 mainly aims to allow a lot of users to play games repeatedly to attain some profit, and is installed into a predetermined facility such as a store. This type of game machine 2 is called an arcade game machine, in some cases. The game machine 2 in this embodiment is a game machine using medals, that is, so-called a medal game machine.

The game machine 2 is provided with a plurality of station units ST. In an embodiment shown in FIG. 1, first to fourth station units ST1 to ST4 (a referential mark "ST" represents them in some cases) are provided to the game machine 2.

Because hiding in the back, the fourth station unit ST4 is invisible. Each station unit ST is a unit which allows a user to play a medal pusher game as one example of a medal game using medals M. At the center of the game machine 2, a center game unit 11 is provided. The center game unit 11 is for providing a user with a lottery game associated with the medal pusher game of each station unit ST. The center game unit 11 has a pair of flat display surfaces being arranged so as to face in an opposite direction to each other (the display surface in the back is invisible in FIG. 1), and is shared by all of the station units ST. The center game unit 11 is set for providing a predetermined lottery games for a user of each station unit ST. The details thereof will be described later. On the other hand, a subsidiary game unit 12 is provided between two of the station units ST which are adjacent to each other. The subsidiary game unit 12 is shared by the two station units ST adjacent to each other. The subsidiary game unit 12 has a book type screen 12*a* and a not illustrated projector which displays a game image on the screen 12*a*, and provides various kinds of lottery games associated with the medal pusher game and the like by using the screen 12*a*. In FIG. 1, some appropriate members for the game machine 2 are omitted.

Figure 2:
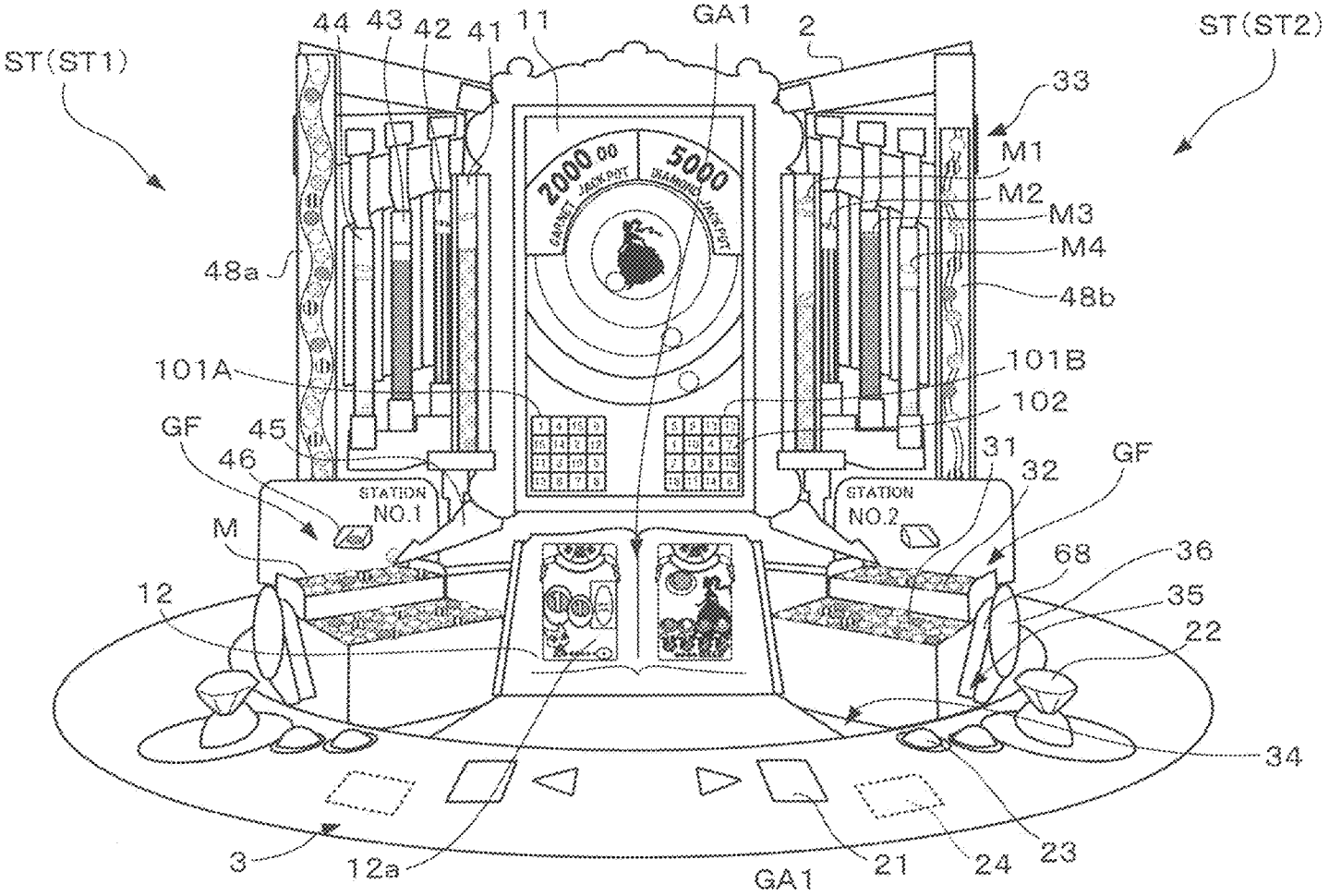
FIG. 2 is an enlarged view of a station unit provided to one game providing area.

FIG. 2 is an enlarged view of the station unit ST. Each station unit ST is configured for a single user. The two station units ST sharing the subsidiary game unit 12 are located on the same side to one of the display surfaces of the center game unit 11. The area where those two station units ST are located is positioned as a single game providing area GA to the center game unit 11. Hereinafter, in some cases, the side of the first and second stations units ST1 and ST2 is referred to as a first game providing area GA1 and the side of the third and fourth station units ST3 and ST4 is referred to as a second game providing area GA2 (see FIG. 1). Each of the display surfaces of the center game unit 11 is shared by the two station units ST included in each of the game providing areas GA. That is, a user of each station unit ST can play the lottery game provided via the display surface of the center game unit 11, while recognizing a game state progressing independently at the station unit ST.

Each station unit ST is provided with: an operation portion 3 where a user operates a game; and a game field GF where the game progresses in response to the operation of the user. At the station unit ST, the game progresses by using physical movement of medals M which are inserted to the game field GF. Each medal M which is inserted to the game field GF is a medal which is circulated internally in the game machine 2, and has different conception from a medal which is inserted by the user or dispensed to the user (hereinafter, such a medal is referred to as a game-play medal, in some cases).

The operation portion 3 of the station unit ST is provided with a medal insertion slot 21 for the game-play medals which are inserted into the game machine 2, an insertion operation lever 22 for the medals M which are inserted to the game field GF, operation buttons 23 for various operations, a card reader 24 which reads a card 4 of the user, and a medal dispensing opening 25 (see FIG. 1) for the game-play medals which are dispensed to the user. The game-play medals inserted to the medal insertion slot 21 are detected by a medal detection sensor not illustrated, and stored, as a credit, in association with identification information of the station unit ST or the user in an appropriate storage portion of the game machine 2. By operating the insertion operation lever 22, the user is allowed to insert the medals M to the game field GF within a range of his/her own credit.

The station unit ST is provided with: a table 31 where the medals M are bedded; a pusher table 32 which performs a reciprocal motion backward and forward on the upper surface of the table 31; a medal supply mechanism 33 which supplies the medals M on the pusher table 32; a drop portion 34 where the medals M drop; a collection portion 35 located at each side of the table 31 where the medals M are collected; and an out-zone adjustment mechanism 36 which is provided to the collection portion 35 to adjust an out-zone of the medals M. The table 31 is fixed to the game field GF. By the reciprocal motion of the pusher table 32, the medals M on the pusher table 32 or the medals M on the table 31 are pushed out to move. The pusher table 32 performs the reciprocal motion according to operations of a drive mechanism not illustrated. The game field GF means a space where the game using the medals M progresses, and includes the table 31, the pusher table 32, the drop portion 34, and the collection portion 35.

The medals M are resin medals, each having an IC chip (not illustrated) where its identification information is recorded. The medal M has a plurality of attributions. As one example, there are a blue medal M1 which is supplied to the game field GF in response to an operation to the insertion operation lever 22, and which one-credit value is set to, a green medal M2 to which two-credit value is set, a red medal M3 to which three-credit value is set, a bingo medal M4 which is linked with each of a plurality of blocks in a bingo sheet 101 (see 101A and 101B of FIG. 2) for a bingo game. In a case that the blue medal Ma drops to the drop portion 34, one credit is given to the user, and similarly, in a case that the green medal M2 and the red medal M3 drop to the drop portion 34, two-credit and three-credit are given to the user respectively. Each color medal M1 to M3 is made using resin having translucency of the corresponding color. In the IC chip of each of the color medals M1 to M3, identification information of each color is recorded. The bingo medal M4 is made of resin having translucency of yellow. The resin having translucency includes transparent resin and translucent resin, and may be any resin which makes light pass through.

The medal supply mechanism 33 is provided with: a blue-medal storage container 41 storing the blue medals M1; a green-medal storage container 42 storing the green medals M2; a red-medal storage container 43 storing the red medals M3; a bingo-medal storage container 44 storing the bingo medals M4; a medal insertion guide 45 which inserts the blue medal M1 to the game field GF; and a common insertion guide 46 which is shared by the green medal M2, the red medal M3, and the bingo medal M4 which are being inserted to the game field GF. The medals M which have dropped from the drop portion 34 are collected by a medal hopper not illustrated, and, from the medal hopper, transmitted above the medal storage containers 41 to 44 via an appropriate medal transmission mechanism. On the way of the transmission, the identification information of each of the medals M is read out by an IC reader, and by a predetermined sort mechanism, each of the medals M is assigned by the attribution according to the identification information to any one of the medal storage containers 41 to 44, and stored therein. The green-medal storage container 42, the red-medal storage container 43, and the bingo-medal storage container 44 are shared by the adjacent two station units ST. On the other hand, the blue-medal storage container 41 is provided for each station unit ST one by one.

On the display surface of the center game unit 11, there are displayed bingo sheets 101A and 101B for the bingo game which is executed at each station unit ST (the station unit ST located on the left side in FIG. 2 is referred to as a first station unit ST1, and the other station unit ST located on the right side in FIG. 2 is referred to as a second station unit, in some cases.). Each bingo sheet 101A, 101B has 16 cells in a 4×4 matrix shape. To each cell 102, a number selected from bingo numbers 1 to 16 is assigned. On the other hand, to each bingo medal M4, any one of the bingo numbers 1 to 16 is assigned. The identification information of the assigned bingo number is recorded in the IC chip of the bingo medal M4, and the bingo number assigned is displayed on the surface of the bingo medal M4. However, with respect to a part of the bingo medals M4, instead of the bingo number, identification information of "lottery" indicating execution of a roulette lottery for the bingo number, or identification information of "designation" indicating activation of the bingo number a user demands is recorded. On the surface of such a bingo medal M4, some design corresponding to each function is displayed.

The following describes the schematic flow of the medals M in the game field GF. The user pays a charge, or consumes virtual money, according to the number of game-play medals to be lent, to an operator of the store where the game machine 2 has been installed. When the user inserts the game-play medals to the medal insertion slot 21, the game-play medals are counted as the credit, and the counted number of credits is stored in an appropriate storage portion. When the user operates the insertion operation lever 22, the blue medals M1 is supplied to the game field GF via the medal insertion guide 45. At this moment, when the user operates the operation portion 3, an insertion direction of the medal insertion guide 45 can be changed. On the table 31 and the pusher table 32 of the game field GF, the medals M1 to M4 are bedded in a state that they contact with each other. When the medal M1 is inserted, a pushing force caused by the reciprocal motion of the pusher table 32 is transmitted to the medals M bedded from the front edge portion of the pusher table 32 to the front edge portion of the table 31, and thereby some medals M located at the front edge portion of the table 31 are pushed out and drop to the drop portion 34. Alternatively, some medals M drop from a side of the table 31, and are collected by a medal hopper 47. In the pusher game of the present embodiment, only the medals M1 to M4 are arranged on the game field GF in a bedded state. Each of the medals M which have dropped to the drop portion 34 is returned to any one of the medal storage container 41 to 44 after the identification information (the attribution) thereof is read out as mentioned above. According to the identification information read out, various kinds of processing, such as lending the credit, dispensing the game-play medals from the medal dispensing opening 25, progressing the bingo game, executing the roulette lottery.

Figure 3:
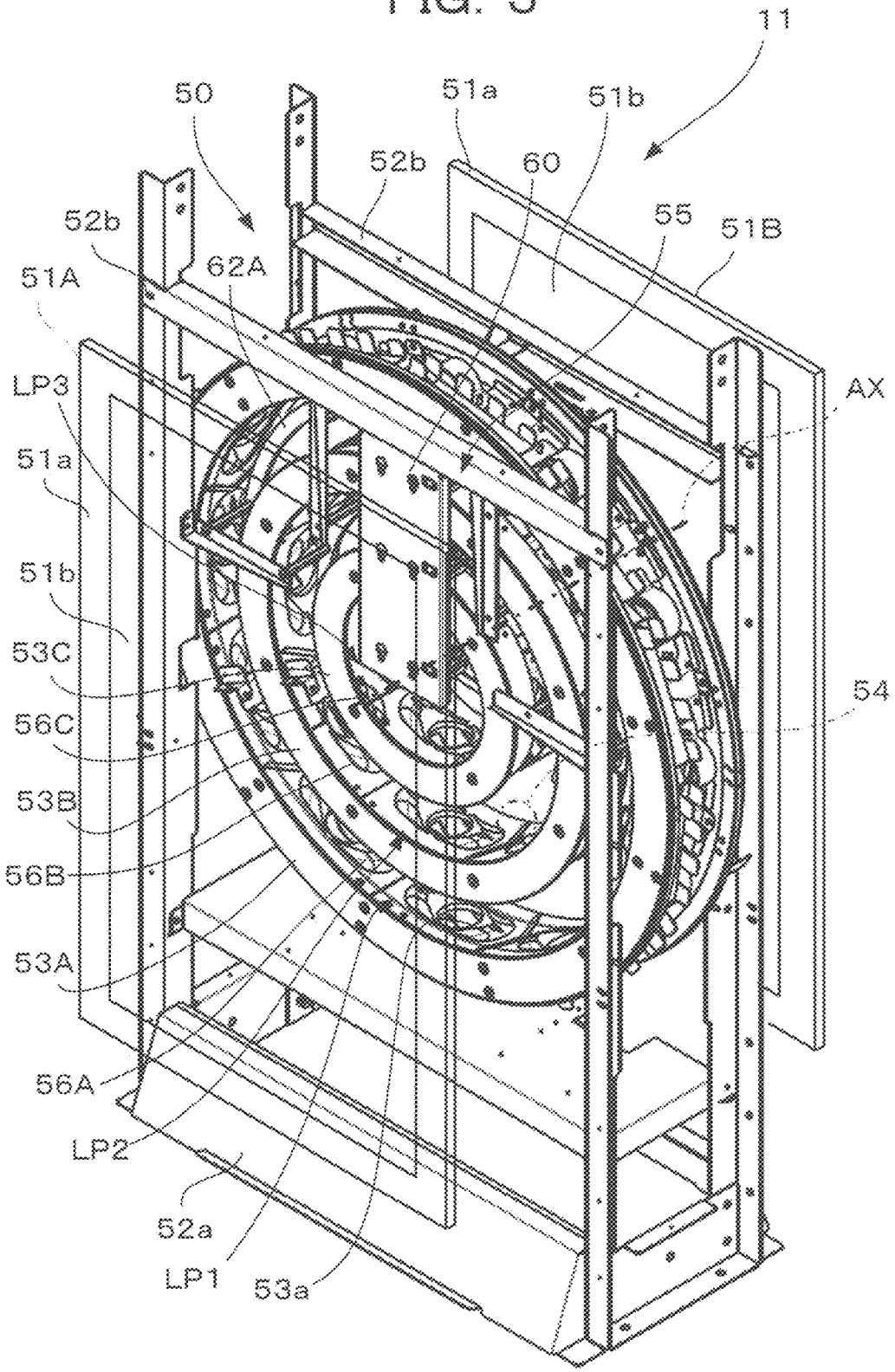
FIG. 3 is an oblique perspective view showing a state that a center game unit is partially deconstructed.

Next, the details of the center game unit 11 will be described in reference to FIGS. 3 to 10. As shown in FIG. 3, the center game unit 11 has a lottery mechanism 50 and a pair of display devices 51A and 51B arranged so that the lottery mechanism 50 is sandwiched therebetween. Hereinafter, 51 is used as a representative referential mark of the display device, thereby, the display device 51 will be used in some cases. Similarly, also, for each of the other constructional elements, a referential mark without a suffix A, B, . . . is used as a representative referential mark in some cases. The surface of each display device 51 corresponds to the display surface shown in FIGS. 1 and 2. One display device 51A is arranged so that the display surface thereof faces the first game providing area GA1, the other display device 51B is arranged so that the display surface thereof faces the second game providing area GA2. A liquid crystal panel is used for each display device 51. Here, the liquid crystal panel does not include any opaque member such as a light source a polarizing plate, and a reflective plate in the back, and is allowed to set all over a screen 51*b* except a frame portion 51*a* as a transmission region. The display device 51 is, by controlling a direction of liquid crystal, capable of displaying image at an appropriate position and thereby decreasing the visibility of the back of the image. However, the display device 51 is not limited to an example where the liquid crystal panel is used, and any other display device, such as an organic EL panel or a projector, may be employed, as long as the display device is capable of generating a transmission region and an image display region on its screen. Here, "decreasing the visibility" includes both states: one state that the back is less visible to a user; and another state that the back is completely invisible to a user. The visibility can be set as appropriate by adjusting the contrasting density of the image.

Figure 4:
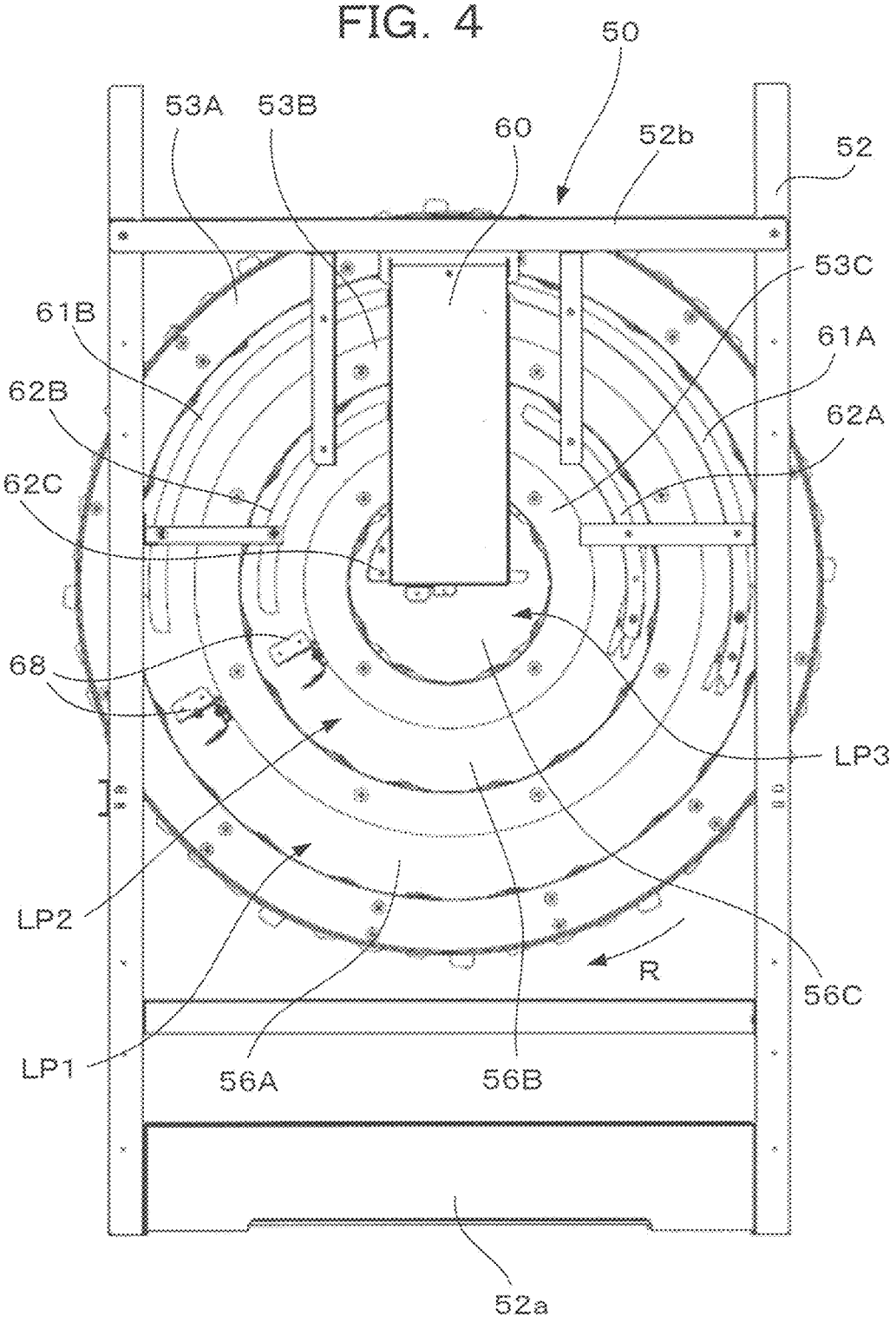
FIG. 4 is a front view of a lottery mechanism.
Figure 5:
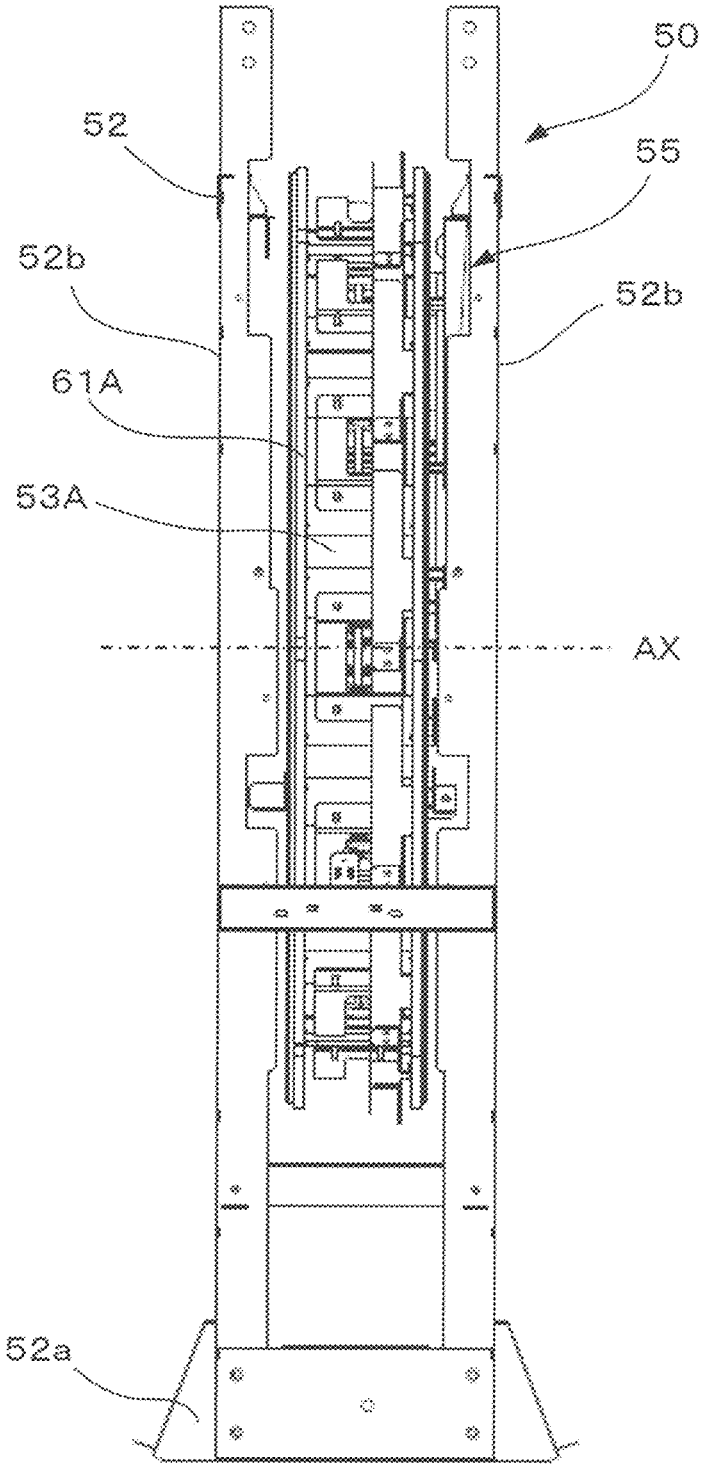
FIG. 5 is a left-side view of the lottery mechanism.

As shown in FIGS. 3 to 5, the lottery mechanism 50 has a frame 52, three lottery rings supported by the frame 52: a large lottery ring 53A; a middle lottery ring 53B; and a small lottery ring 53C, and an insertion mechanism 55 which inserts a ball 54 (see FIG. 9) as a game medium, to an inner circumference of each of the lottery rings 53. The frame 52 has a base portion 52*a* and a pair of vertical frame portions 52*b*, the pair being arranged on the front and back of the lottery mechanism 50. The display device 51 is mounted to an outside of the vertical frame portion 52*b*. The lottery rings 53A to 53C are arranged coaxially by using as a center, a pivot axis AX extending in a horizontal direction. The inner circumference of each lottery ring 53 is provided with a gap which should be a lottery passage 56A, 56B, or 56C for the ball 54. To the inner circumference of each lottery ring 53, a plurality of pockets 53*a* as a plurality of lottery positions any one of which the ball 54 enters selectively are provided in a circumferential direction at appropriate intervals. Because of a difference in the length of the diameter (or the length with respect to the circumferential direction) between the lottery rings 53A, 53B, and 53C, the number of pieces of the pockets 53*a* decreases in this order: the large lottery ring 53A, the middle lottery ring 53B, and the small lottery ring 53C.

The lottery rings 53 are mounted to the frame 52 in a rotatable manner around the pivot axis Ax. That is, it is impossible for the lottery rings 53 to rotate relatively to each other. The lottery rings 53 are driven to rotate around the pivot axis AX integrally by a drive device not illustrated. The drive device is, as one example, configured to drive a roller contacting with an outer circumference of the large lottery ring 53A to rotate by some drive source such as an electric motor. Alternatively, the lottery rings 53 may be allowed to rotate relatively to each other, and each of the lottery rings 53 may be individually driven to rotate by the drive source. When the ball 54 is inserted from the insertion mechanism 55 to the lottery passage 56, the ball 54 reciprocates in the circumferential direction in a lower area of the lottery passage 56 according to the rotation of the lottery ring 53, and eventually enters any one of the pockets 53*a*, thereby the lottery is performed. The pivot axis AX for the lottery rings 53 faces the center of each game providing area GA with respect to a circumferential direction of the game machine 2. As apparent from the above, in the present embodiment, the lottery mechanism 50 is provided with three lottery portions: a large one LP1; a middle one LP2; and a small one LP3 (a referential mark "LP" is sometimes used as a representative mark of them), by the lottery rings 53A to 53C, the lottery passages 56A to 56C which are the inner circumferences of the lottery rings 53A to 53C, and the balls 54 inserted to the lottery rings 56A to 56C. And the screen 51*b* of the display device 51 is arranged between the game providing area GA and the lottery mechanism 50. Accordingly, in a case that any image is not displayed on the screen 51*b* of the display device 51, the lottery state of each lottery portion LP can be seen through the transmission region of the screen 51*b* from each game providing region GA. On the other hand, it is possible to decrease the visibility of the lottery portions LP1 to LP3 individually and selectively by some image on the display device 51.

Figure 6:
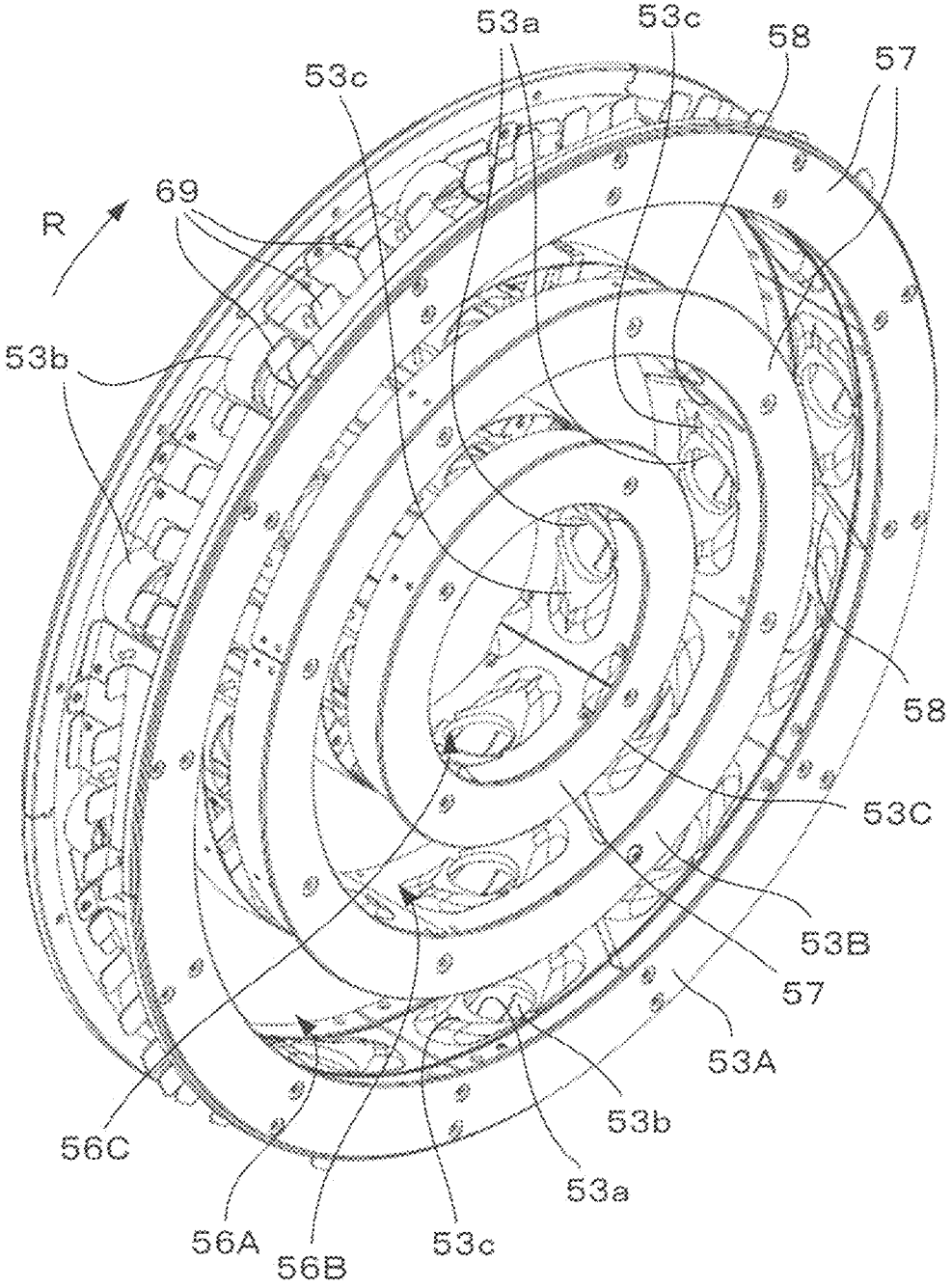
FIG. 6 is an oblique perspective view of lottery rings

As apparent from FIG. 6, to each side of each lottery ring 53, a light guide plate 57 is mounted like making a circuit of the lottery ring 53. The light guide plate 57 is illuminated from its outer circumference or from its inner circumference by an illumination device not illustrated. Thereby, the light guide plate 57 becomes luminous, and thereby it is possible to illuminate the screen 51*b* of the display device 51 from behind. The illumination functions as back light for image displayed on the screen 51*b*. Not illustrated, but the upper area of the lottery ring 53 (generally, an area upper side than the pivot axis Ax) may be covered almost over all by the light guide plate. The upper area of each the lottery ring 53 is an area to which users do not pay attention in the middle of a lottery of each lottery portion LP. Therefore, it is not necessary for the users to be made to observe the upper area through the screen 51*b*. Due to this, there would be no problem if the upper area is covered by the light guide plate.

In the inner side of each pocket 53*a* of the lottery rings 53, a stopper 53*b* is provided so as to prevent the ball 54 which entered the pocket 53*a* from going to the outer circumferential side. Further, to the mouth portion of the pocket 53*a* on the inner circumferential surface of the lottery ring 53, a protruding portion 53*c* is provided so as to produce appropriate resistance to the entrance of the ball 54. As shown in detail in FIG. 7, the protruding portion 53*c* has its width which is a little larger than an internal diameter of the pocket 53*a*, and also the protruding portion 53*c* is extended to both sides in the circumferential direction with respect to the pocket 53*a* with appropriate length. On the inner circumference of each of the large lottery ring 53A and the middle lottery ring 53B, there is a projecting portion 58 between the protruding portions 53*c*. The projecting portion 58 comprises a pair of projecting threads 58*a* extended in an almost v-shape which running forward with respect to the rotational direction of the lottery ring 53 (a direction indicated by an arrow R in FIG. 6) from the center portion with respect to the width direction of the lottery ring 53. The tips of the projecting threads 58*a* almost reach both sides with respect to the width direction of the lottery ring 53 respectively.

Further, the width of the lottery ring 53 (the size with respect to the direction of the pivot axis AX) is set to be larger than a diameter of the ball 54. Accordingly, in the lottery passage 56, the ball 54 hits against the protruding portion 53*c* or the projecting portion 58 so as to change its moving direction. Thereby, the ball 54 repeats its moving, not only in the circumferential direction but also in the width direction. The reason why the ball 54 is allowed to move in such a way is that an eye-catching effect or a dramatic effect of the lottery is promoted by allowing the ball 54 to move not only in the circumferential direction of the lottery ring 53 but also in the width direction thereof. Further, in order to remove a possibility such that the ball 54 moves in only one side with respect to the width direction of the lottery ring 53, thereby both sides of the game providing areas GA differs in view of the ball 54, the projecting portion 58 is further provided between the pockets 53*a*. That is, in a case that the ball 54 moves to one side with respect to the width direction relative to the protruding portion 53*c* existing at the mouth of the pocket 53*a*, if there is not anything which works as a trigger, the ball 54 would repeat swinging motion in the circumferential direction on the same side with respect to the width direction, and thereby there is a possibility to continue a state that the ball 54 has gone to the back from the game providing area GA on the other side with respect to the width direction. In consideration of that, the projecting portion 58 is provided at an appropriate position between the pockets 53*a* as a trigger which makes the ball 54 move from one side to the other side with respect to the width direction.

Figure 8:
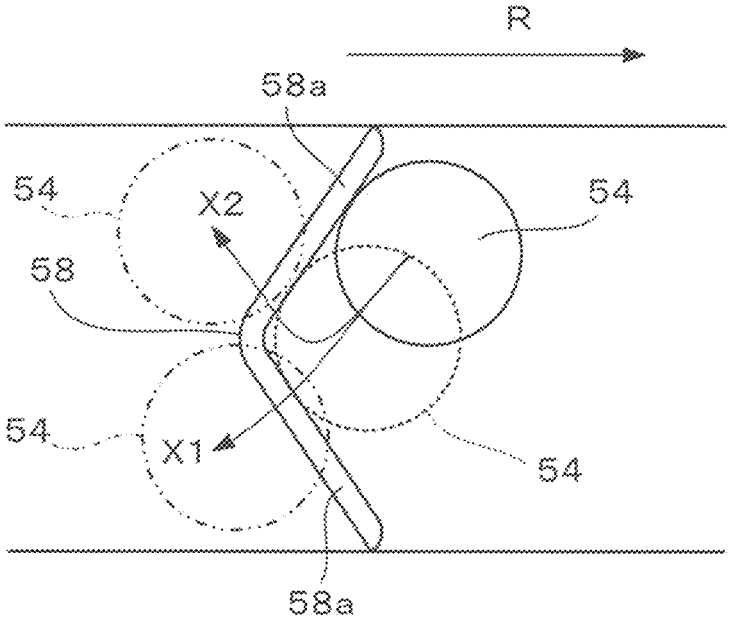
FIG. 8 is a partial development view of the inner circumferential surface of the lottery ring.

Further, the pair of projecting threads 58*a* is provided to the projection portion 53 in order to promote irregularity of motion of the ball 54 with respect to the width direction. That is, as shown in FIG. 8, in a case that the ball 54 hits against one of the projecting threads 58*a*, the ball 54 is guided toward the center with respect to the width direction of the lottery ring 53 (the vertical direction in FIG. 8) according to the inclination of the projecting thread 58*a*. However, since the direction of the projecting thread 58*a* is changed at the center with respect to the width direction, the ball 54, as shown by an arrow X1 in FIG. 8, would climb over the other one of the projecting threads 58*a* and move to the opposite side with respect to the width direction of the lottery ring 53, or as shown by an arrow X2 in FIG. 8, the ball 54 would be pushed by the other one of the projecting threads 58*a* and returned to the one side with respect to the width direction. Whether the ball 54 performs motion according to the arrow X1 or the arrow X2 is determined depending on physical parameters such as speed of the ball 54 at the moment of hitting against the projecting portion 58. Accordingly, a regularity such that the ball 54 moves with switching from one side to the other side with respect to the width direction at a fixed position at all times is removed, and thereby it is possible to promote the irregularity with respect to motion of the ball 54. In addition, in a case that the projecting portion is formed as a single projecting thread inclining uniformly from one side edge to the other side edge with respect to the width direction of the lottery ring 53, though such a projecting thread works as a trigger which makes the ball 54 move with respect to the width direction, the ball 54 performs almost regular motion at the projection portion.

Figure 9:
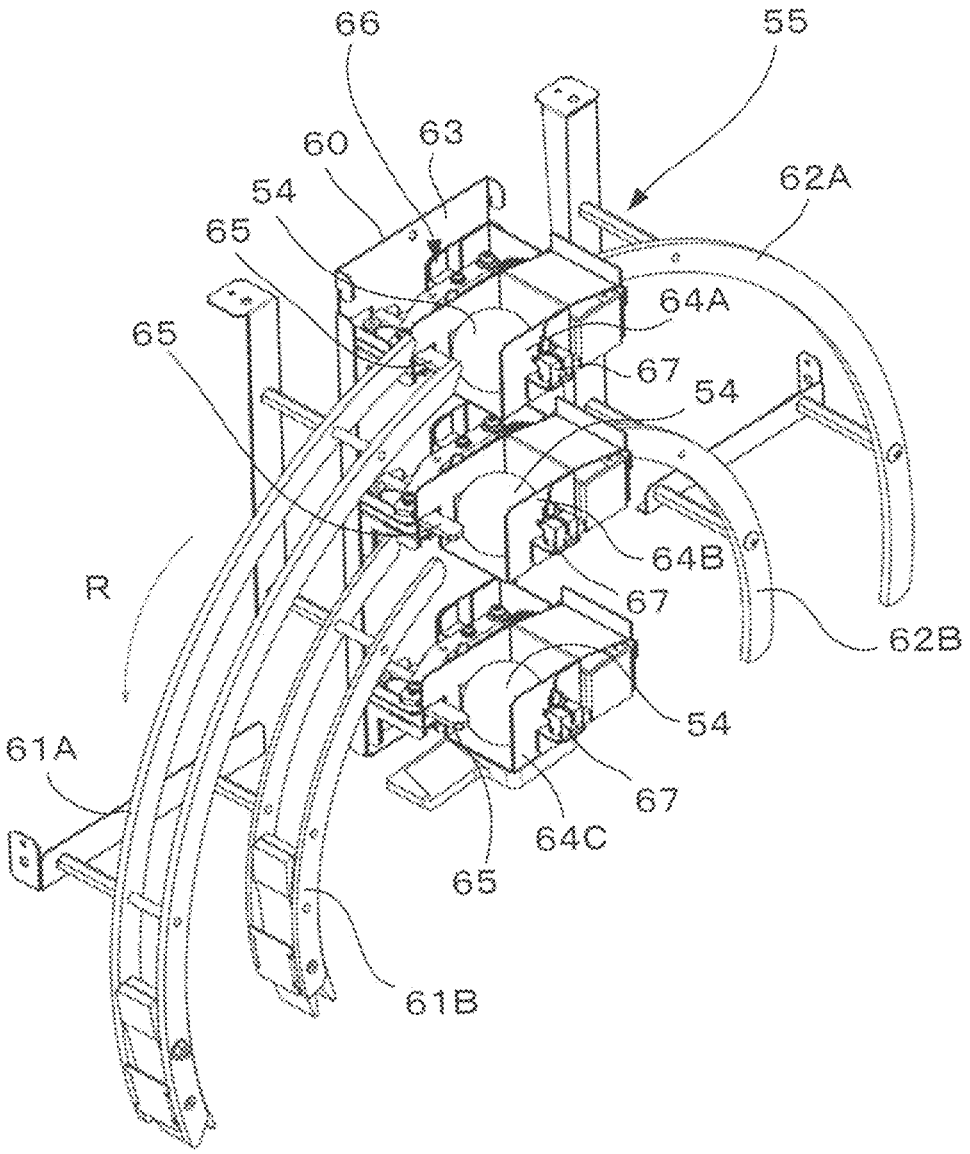
FIG. 9 is an oblique perspective view of an insertion mechanism.
Figure 10:
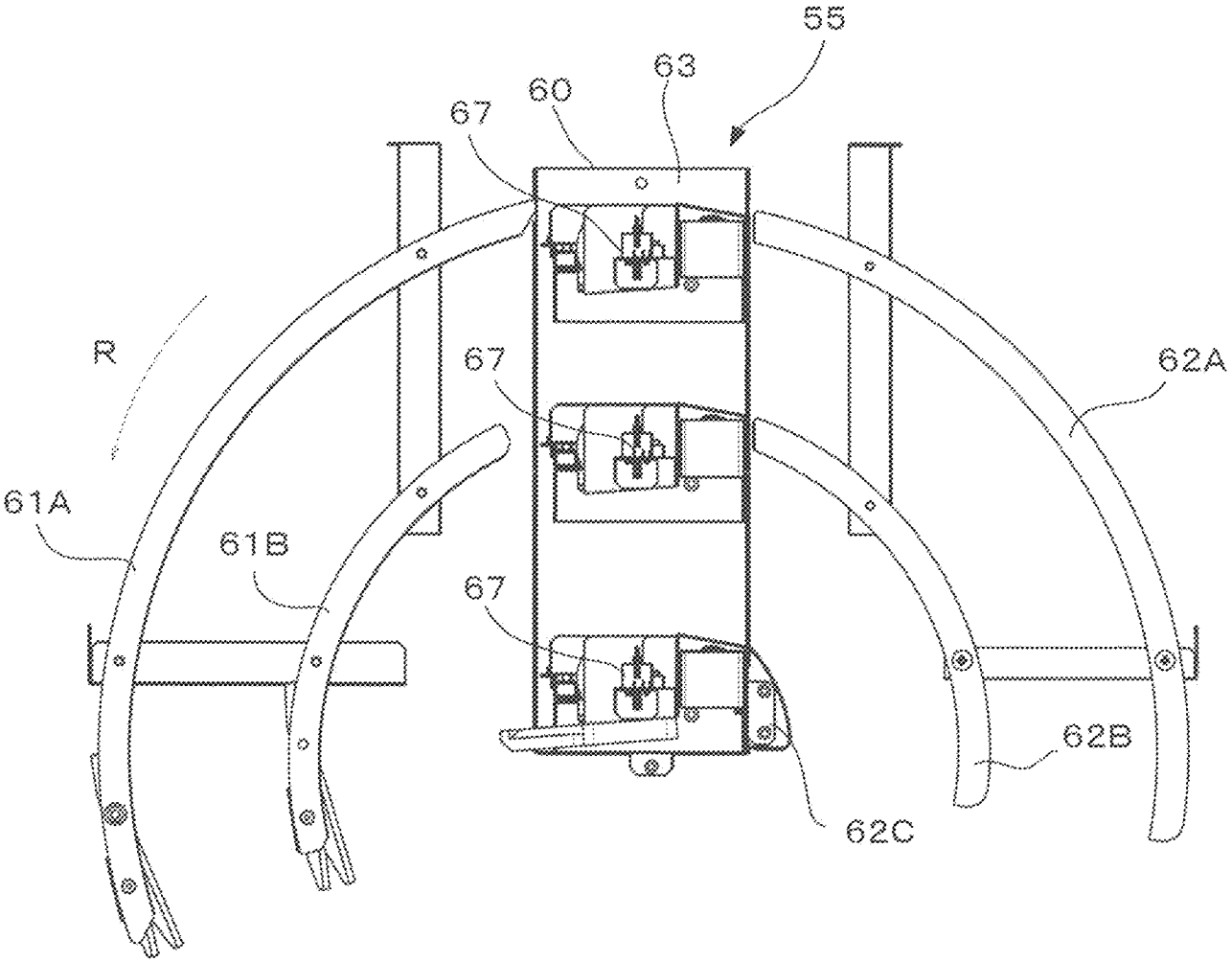
FIG. 10 is a front view of the insertion mechanism.

FIGS. 9 and 10 show the details of the insertion mechanism 55. The insertion mechanism 55 comprises: a base 60; ball insertion guides 61A and 61B, each extending from one side of the base 60 in an arc; and ball collection guides 62A and 62B, each extending from the other side of the base 60 in an arc. The base 60 is provided with a basal plate 63, and three ball holders 64A to 64C which are mounted to the basal plate 63 so as to be arranged in the vertical direction. The basal plate 63 is mounted to one of the vertical frame portions 52*b* of the frame 52 (see FIG. 3), thereby the insertion mechanism 55 is placed at a fixed position in the upper portion of the frame 52. The ball holder 64 has a size so as to hold a single ball 54. The ball holder 64A of the top position is arranged for the lottery passage 56A of the inner circumference of the large lottery ring 53A, the ball holder 64B of the middle position is arranged for the lottery passage 56B of the inner circumference of the middle lottery ring 53B, and the ball holder 64C of the bottom position is arranged for the lottery passage 56C of the inner circumference of the small lottery ring 53C.

The ball holder 64 is formed in a bucket shape which opens at its upper side and at the side where the ball insertion guide 61 is provided, and the opening portion located with respect to its circumferential direction is provided with a stopper 65 in order to prevent a ball 54 from dropping down. The stopper 65 is, by a drive mechanism 66 mounted to the basal plate 63, driven between a position for holding a ball 54 in the ball holder 64 (the position is shown in FIG. 2) and a position for allowing the ball 54 to drop down by pulling back from the opening portion of the ball holder 64. The drive mechanism 66 is configured to, as one example, use an electromagnetic actuator as a drive source, and convert operations of the drive source into operations of the stopper 65 by a link mechanism or the like. To the ball holder 64, a sensor 67 which detects whether a ball 54 stays or not is also mounted.

The ball insertion guide 61 and the ball collection guide 62 are provided as a device which guides a ball 54 along the inner circumference of the lottery ring 53. The ball insertion guide 61A and ball collection guide 62A, located at the outer side, curve with a little larger curvature than the inner circumference of the large lottery ring 53A, and the ball insertion guide 61B and ball collection guide 62B, located at the inner side, curve with a little larger curvature than the inner circumference of the middle lottery ring 53B. As shown in FIGS. 3 and 4, in a case that the base 60 of the insertion mechanism 55 is mounted to the frame 52, the ball insertion guide 61A and ball collection guide 62A are inserted to the upper area of the lottery passage 56A corresponding to the large lottery ring 53A so as to be arranged along the inner circumference of the large lottery ring 53A. And, the ball insertion guide 61B and ball collection guide 62B are inserted to the upper area of the lottery passage 56B corresponding to the middle lottery ring 53B so as to be arranged along the inner circumference of the middle lottery ring 53B.

The ball holder 64 is arranged so that a ball 54 held therein contacts somewhat with the inner circumference of the lottery ring 53. The opening portion with respect to the circumferential direction of the ball holder 64 and the ball insertion guide 61 faces forward with respect to the rotational direction of the lottery ring 53 (the direction of the arrow R in FIG. 9). Accordingly, when the stopper 65 is made to pull back from the ball holder 64, the ball 54 is made to get out of the ball holder 64 according to the rotation of the lottery ring 53, and drops down to the lower area of the lottery passage 56 along the ball insertion guide 61. On the other hand, the ball 54 which has entered the pocket 53*a* of the lottery ring 53 is transported by the lottery ring 53. At the upper area, the ball 54 contacts with the ball collection guide 62, thereby without dropping down from the pocket 53*a* the ball 54 is transported above the ball holder 64. Since there is no ball collection guide 62 just above the ball holder 62, the ball 54 which has reached above the ball holder 64 drops to the ball holder 64 from the pocket 53*a*, and thereby the ball 54 is collected into the insertion mechanism 55. With respect to the small lottery ring 53C, the ball insertion guide is omitted. Further, as apparent from FIG. 4, the base 60 is also provided with a ball collection guide 62*c* for the small lottery ring 53C.

Further, the insertion mechanism 55 is provided with a ball sensor 68 (see FIG. 4) which detects whether a ball 54 has entered a pocket 53*a* or not. Further, on the outer circumference of the lottery ring 53, detection chips 69 are also provided, the detection chips 69 being used for identifying each pocket 53*a* and the like. The detection chips 69 are provided so as to be arranged differently for each pocket 53*a*. The detection chips 69 are detected by a sensor such as a photointerrupter set to a fixed position around the lottery ring 53, thereby a detection signal unique for each pocket 53*a* of the lottery ring 53 is generated so that each pocket 53*a* is identified. For example, by setting a predetermined position on the lottery ring 53 as a reference, a pocket number is assigned to each pocket 53*a*. By reference to the detection signal generated by the detection chips 59 and the signal by the ball sensor 68, it is possible to identify the pocket 53*a* where the ball 54 has entered with respect to each lottery ring 53. Alternatively, various ways may be applied for identifying the pocket 53*a* and detecting the ball 54. For example, the pocket 53*a* may be identified by setting an IC chip for each pocket 53*a* and recording identification information of the pocket 53*a* in the IC chip.

Next, in reference to FIGS. 11 to 15, a specific example of each kind game which is performed using the center game unit 11 will be explained. As mentioned above, the lottery mechanism 50 includes the three lottery portions LP1 to LP3. And, the lottery state in each lottery portion LP, that is, the state that a ball 54 moves with swinging on the lottery passage 56 and eventually enters a pocket 53*a*, is possible to be observed from both of the first game providing area GA1 and the second game providing area GA2 opposite to the first game providing area GA1. On the other hand, by displaying appropriate image on the screen 51*b* of the display device 51, it is possible to select at least one part of the lottery portion LP and make the visibility thereof relatively lower than that of the transmission region. Moreover, since the display device 51 is arranged to each side of the lottery mechanism 50, by displaying different image from each other on each display device 51 respectively, it is possible to provide simultaneously lottery games different from each other but using the common lottery mechanism 50, for the game providing areas GA1 and GA2 respectively.

Figure 11:
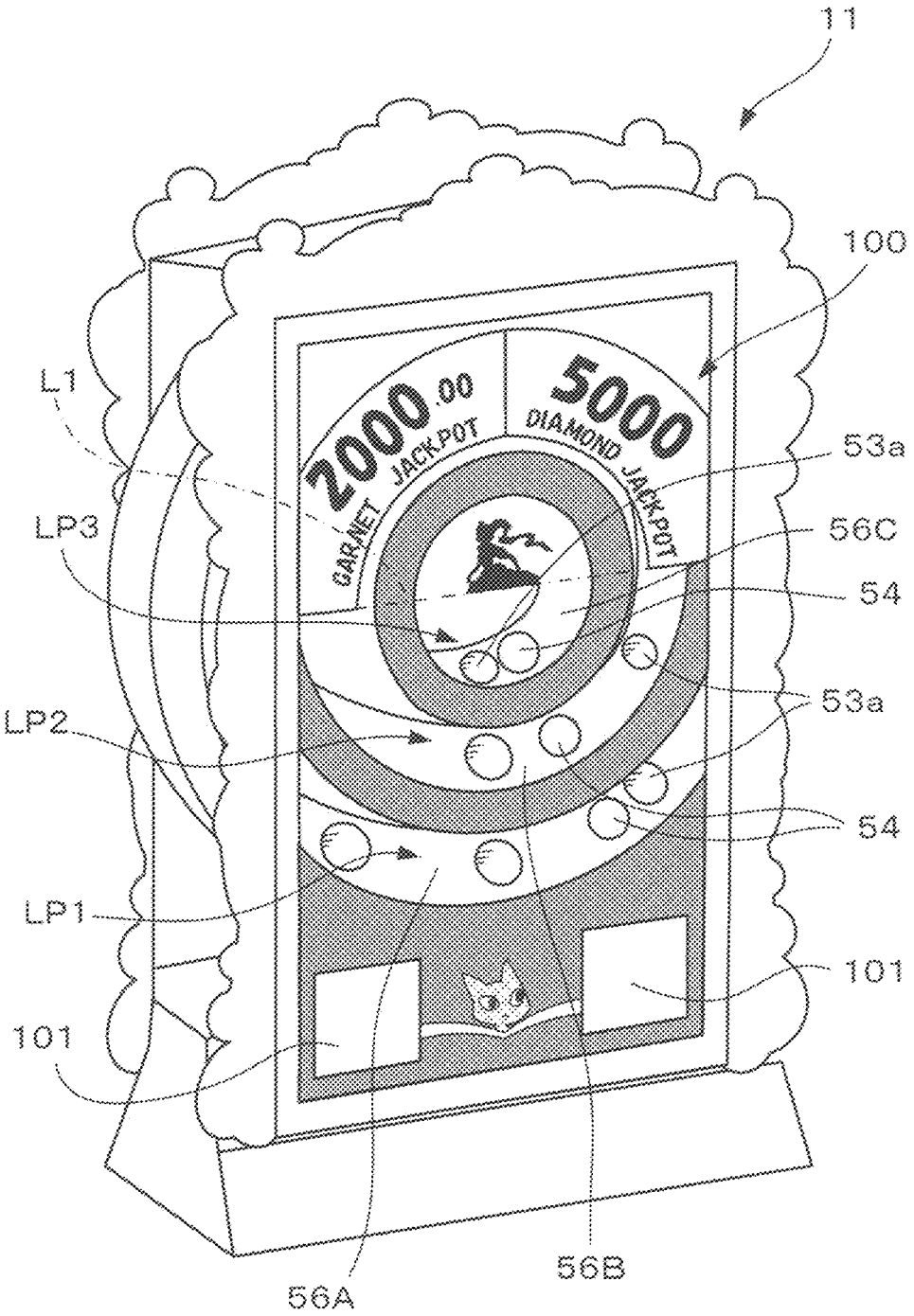
FIG. 11 is an oblique perspective view showing an appearance of the center game unit.

FIG. 11 shows one example of a state that image of the display device 51 is superposed on one side of the lottery mechanism 50. In this example, an image 100 is superposed on an upper area than the center of the lottery rings 53 (an upper side area than a dot-and-dash line L1), the outer circumference of each lottery ring 53, and a lower area than the large lottery ring 53A. In this case, the transmission region is set on the screen 51*b* so that the lottery passages 56A to 56C corresponding to the three lottery portions LP1 to LP3, the pockets 53*a* of each lottery ring 53, and a ball 54 inserted to each lottery passage 56 are observed, and with respect to the other parts of the lottery mechanism 50, their visibility is made to be lower because the image 100 of the screen 51*b* is superposed thereon. Thereby, it is possible to provide the lottery game using the three lottery portions LP to the users of the game providing area GA. If image corresponding to attribution set to each pocket 53*a*, such as its number; its picture; or its dividend, is displayed on a part of the image 100 superposed on a side surface of each lottery ring 53, it is possible to show what attribution has been selected in each lottery portion LP to the users. On the state shown in FIG. 11, for example, if the lottery passage 56C of the small lottery ring 53C is covered with image, it is possible to provide the lottery game using the large and middle lottery rings 53A and 53B to the users. In this way, in the present embodiment, a display state of image is controlled so as to allow the users to observe a lottery state of the lottery portion LP to be used in a game which should be provided to the game providing area GA, and so as to make a lottery state of the lottery portion LP not to be used in a game to be invisible or less-visible. Thereby, for each of a plurality of game providing areas GA, it is possible to execute simultaneously lottery games which differ in a lottery portion LP to be used. Hereinafter, specific examples of the lottery game will be explained by reference to FIGS. 12 to 15.

Figure 12:
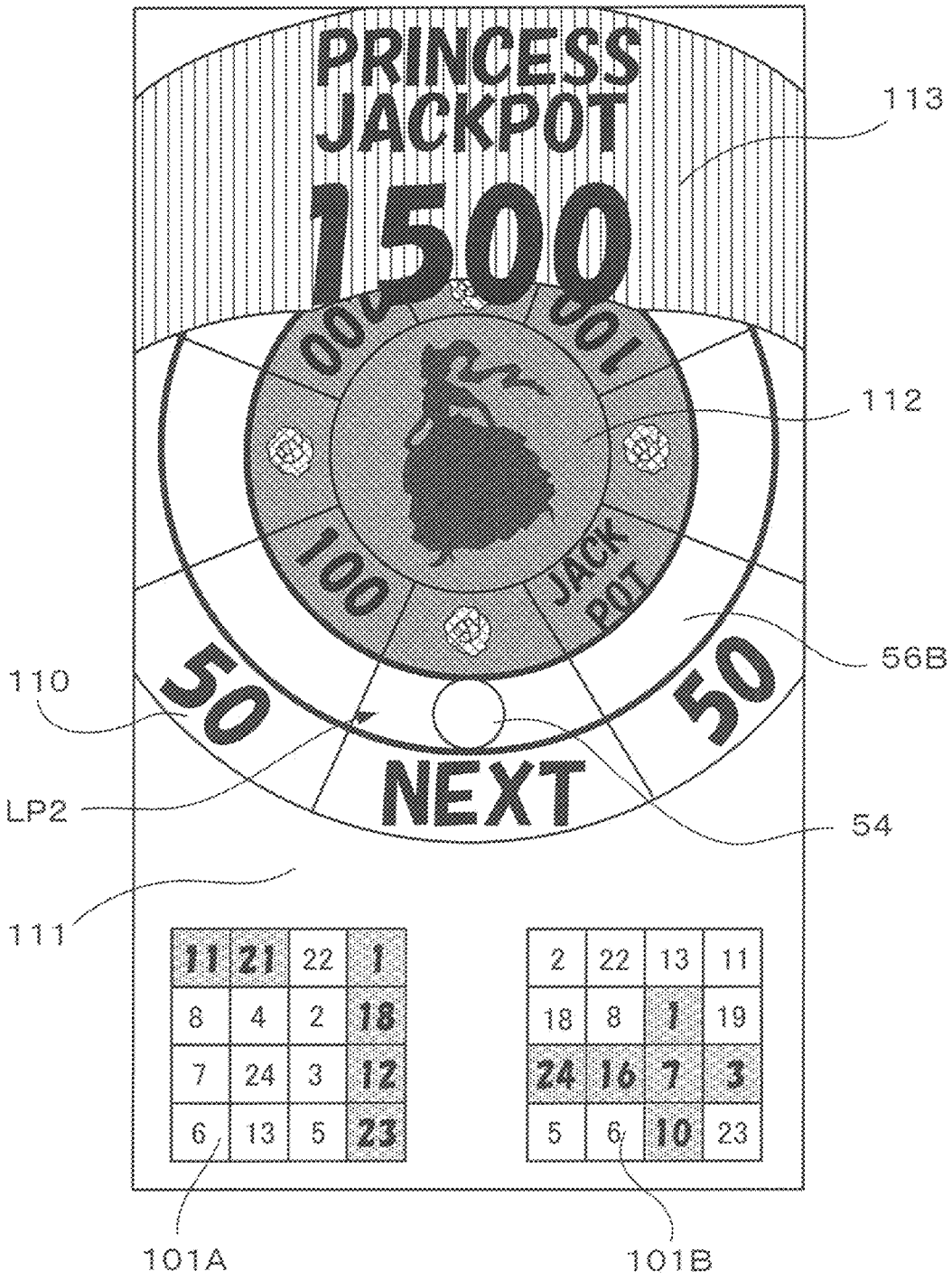
FIG. 12 is a diagram showing one example of a display state in a first stage of a lottery game where a plurality of lottery portions are used sequentially.

FIG. 12 shows one embodiment of display for a sequential-lottery-type lottery game (referred to as the sequential lottery game in some cases) where the plurality of lottery portions LP are used sequentially. Here, the embodiment of display is a state that is presented to the users by a combination of: image displayed by the display device 51; and a part of the lottery mechanism 50 which can be seen through the screen 51*b*. In the game machine 2, for example, when a bingo medal M4 drops down to the drop portion 34 in the medal pusher game on the first station unit ST1, the identification information set to the bingo medal M4 is detected, and then, if the bingo sheet 101A has a cell to which the number corresponding to the detected identification information is assigned, the cell is activated. When all cells aligned at least one direction of the bingo sheet 101A are activated, the sequential lottery game is started for a user of the first station unit ST1 as the lottery right holder. The same also applied to the other station units ST2 to ST4.

In the sequential lottery game, firstly as the first stage thereof, a lottery using only the middle lottery portion LP2 is performed. In this case, a part of about two-thirds of the lottery passage 56B of the middle lottery portion LP2 from its bottom and a ball 54 inserted to the lower portion of the lottery passage 56B can be seen through the screen 51*b*, and, with respect to the other parts of the lottery mechanism 50, some image is displayed on the screen 51*b* so that the visibility of the other parts is made to be lower than the visibility of the part where the middle lottery portion LP2 can be seen through the screen 51*b*. For example, at a region corresponding to the side surface of the middle lottery ring 53B, a ring-shaped attribution image 110 is displayed, the attribution image 110 showing numbers, pictures, and the like each indicating attribution (in this case, a reward) set to each pocket 53*a*. At a region corresponding to the large lottery portion LP1 and lower, a lower part covering image 111 including the bingo sheets 101A and 101B is displayed. A center covering image 112 is displayed on a position of the small lottery portion LP3. Further, an upper part covering image 113 is displayed at a region corresponding to the upper portion of the lottery mechanism 50 (the area where the insertion mechanism 55 should be placed). By these images 110 to 113, it is possible to make the users of the game providing area GA1 recognize certainly that a lottery game using only the middle lottery portion LP2 is being provided. The center covering image 112 also includes pictures and the like indicating the attribution. Those pictures are a previous notice about choices of a lottery to be performed in a case of proceeding to the second stage. Each attribution displayed on the attribution image 110 and on the center covering image 112 moves in the circumferential direction in synchronization with the rotation of the lottery ring 53.

Figure 13:
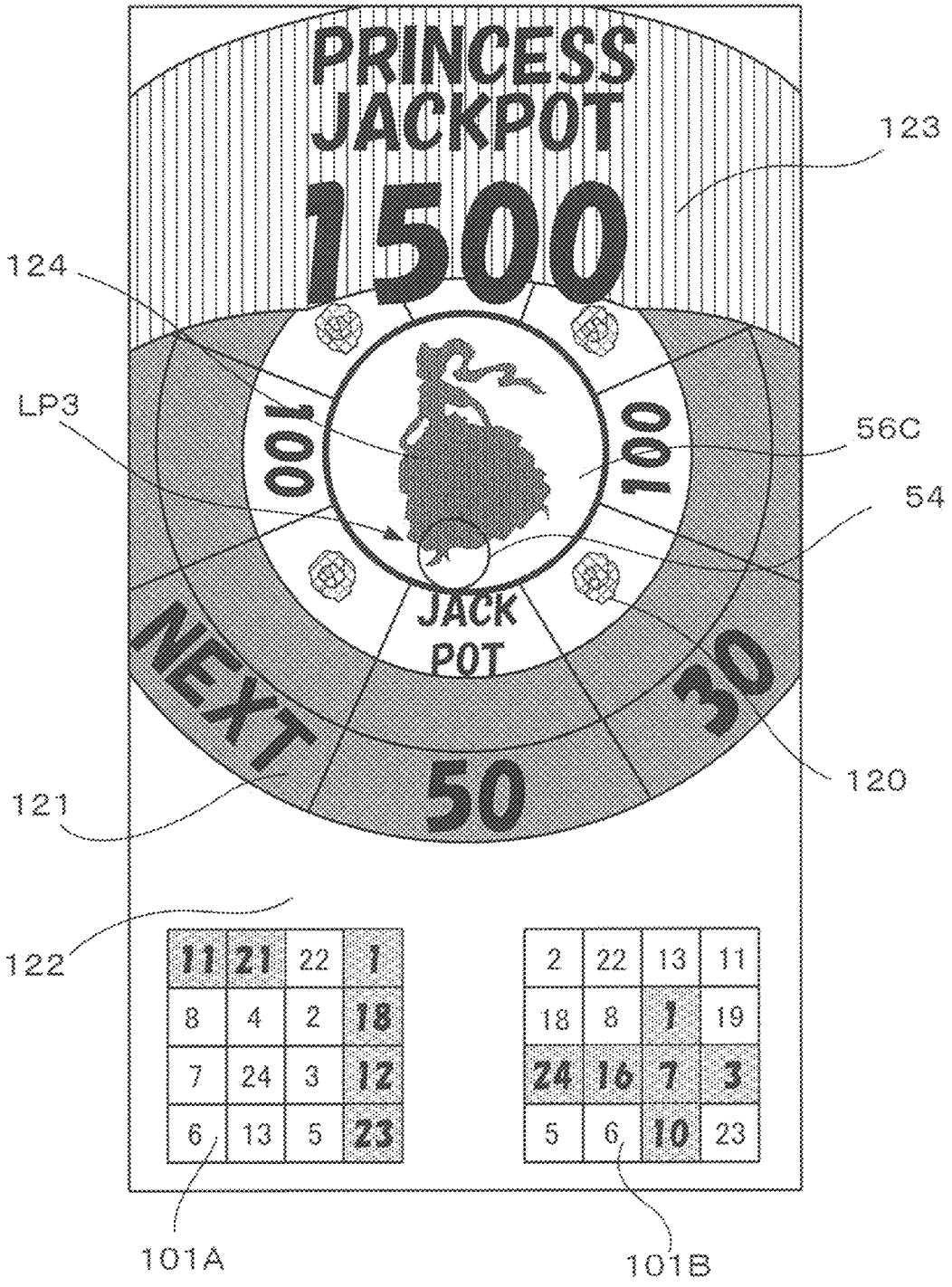
FIG. 13 is a diagram showing one example of a display state in a second stage of the lottery game where the plurality of lottery portions are used sequentially.

When the ball 54 enters a pocket 53*a* showing "NEXT" in the lottery of the first stage, the sequential lottery game proceeds to a lottery of the second stage. In a case that the ball 54 enters a pocket 53*a* other than the pocket 53*a* showing "NEXT", the sequential lottery game ends after dispensing for the user as the lottery right holder, the reward according to the pocket 53*a* which the ball 54 has entered, without proceeding to the second stage. In the second stage, as shown in FIG. 13, a lottery using only the small lottery portion LP3 is performed. In this case, almost the whole of the lottery passage 56C of the small lottery portion LP3 and a ball 54 which has been inserted to the lower portion of the lottery passage 56C can be seen through the screen 51*b*. With respect to the other parts of the lottery mechanism 50, some image is displayed on the screen 51*b* so that the visibility of the other parts is made to be lower. For example, at a region corresponding to the side surface of the small lottery ring 53C, a ring-shaped attribution image 120 is displayed, the attribution image 120 showing numbers, pictures, and the like each indicating attribution (in this case, a reward) set to each pocket 53*a*. And, a ring-shaped center covering image 121 is displayed at a region from the middle lottery portion LP2 to the lottery passage 56A of the large lottery portion LP1. Further, a lower part covering image 122 including the bingo sheets 101A and 101B is displayed at a region lower than the lottery passage 56A, and at a region corresponding to the upper portion of the lottery mechanism 50, the upper part covering image 123 is displayed.

By those images 120 to 123, it is possible to make the users of the game providing area GA1 recognize certainly that the lottery game using only the small lottery portion LP3 is being provided. At the center of the small lottery portion LP3, a symbol image 124 is displayed. This image 124 is limitedly displayed to a degree such that the image 124 does not affect the visibility of the ball 54. Further, the center covering image 121 includes pictures and the like indicating attribution. However, those pictures present just the choices of the lottery for the first stage. Each attribution displayed on the attribution image 120 and on the center covering image 121 moves in the circumferential direction in synchronization with the rotation of the lottery ring 53. When the ball 54 enters any one of the pockets 53*a* in the lottery of the second stage, the sequential lottery game ends, and the reward set to the pocket 53*a* is dispensed to the user as the lottery right holder. For example, in a case that the ball 54 has entered a pocket 53*a* showing "JACK POT", dispensed for the user is the reward being equivalent to a so-called progressive bonus that the game machine 2 accumulates, in a fixed ratio, the amount of credits consumed by users regardless of whoever the users are.

Figure 14:
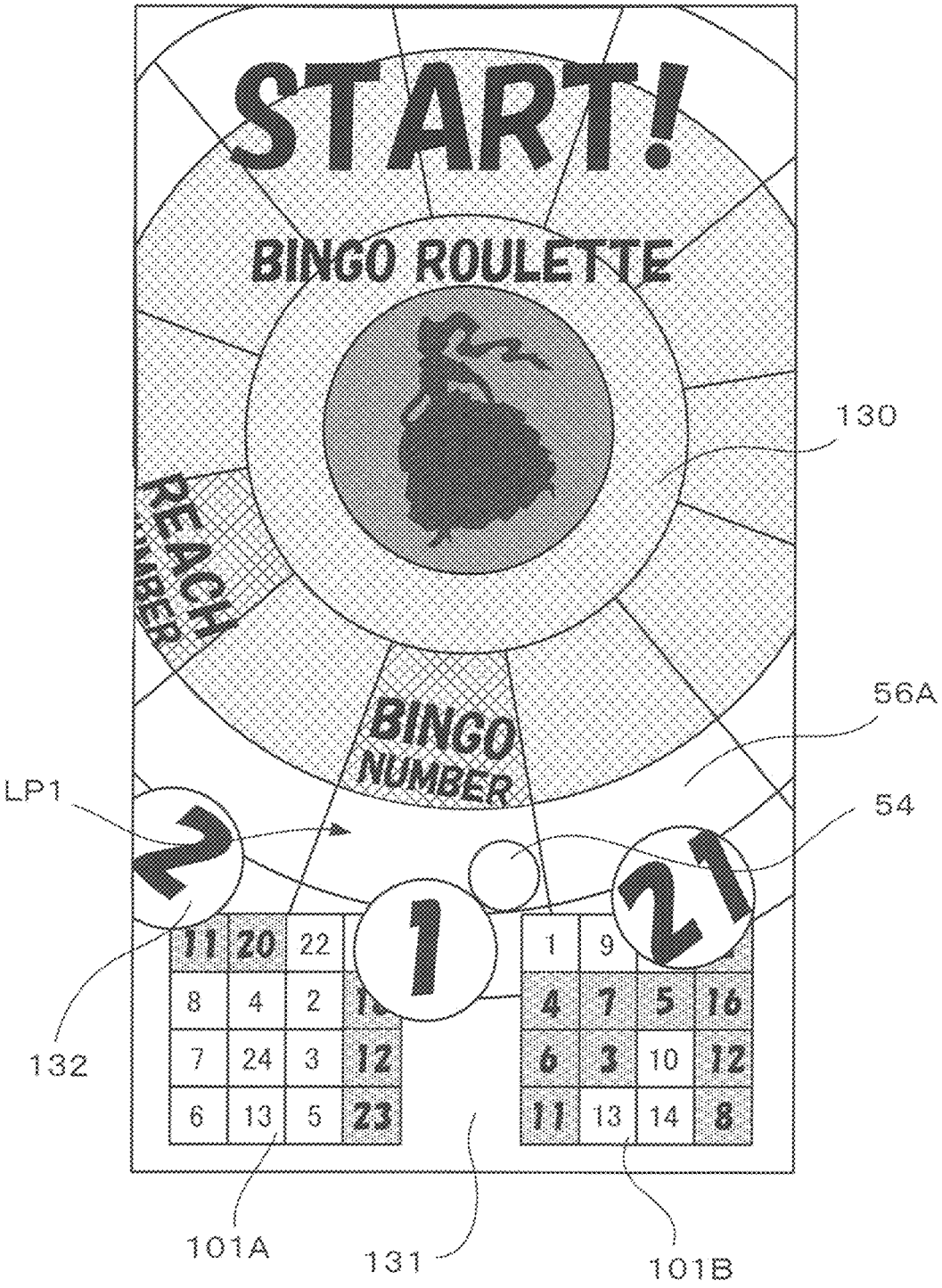
FIG. 14 is a diagram showing one example of a display state in a lottery game where a single lottery portion is used.

FIG. 14 shows one embodiment of display of a single-lottery-type lottery game (referred to as the single lottery game in some cases) using only a single lottery portion LP. In this example, the lottery is performed using only the large lottery portion LP1. The single lottery game shown in FIG. 14 is performed for the user playing the medal pusher game, who is set as the lottery right holder, in the following cases in the medal pusher game: for example, a bingo medal M4 to which the attribute "lottery" is set has dropped down to the drop portion 34; a bingo medal M4 whose number does not exist in the bingo sheets 101A and 101B has dropped down to the drop portion 34: or a bingo medal M4 whose number is the same as the number of activated cell has dropped down to the drop portion 34 at predetermined times.

In the single lottery game, it is possible to see through the screen 51*b*, at least the lower portion (the area where a ball 54 could swing) of the lottery passage 56A of the large lottery portion LP1 and a ball 54 which has been inserted to the lower portion of the lottery passage 56A, and some image is displayed on the screen 51*b* so that the visibility of the other portions of the lottery mechanism 50 is made to be lower. For example, a center covering image 130 is displayed at a region corresponding to the inner side of the lottery passage 56A, and a lower part covering image 131 including the bingo sheets 101A and 101B is displayed at a region corresponding to the lower portion than the lottery passage 56A. Further, an attribution image 132 indicating attribution (in this case, the number) set to each pocket 53*a* is displayed at a region corresponding to the side surface of the large lottery ring 53A. The numbers displayed in the attribution image 132 correspond to the numbers set to the cells which have not yet be activated in the bingo sheet 101 of the lottery right holder. By these images 130 to 132, it is possible to make the users of one of the game providing areas GA recognize certainly that there is being provided a lottery game which uses only the large lottery portion LP1 and by which any one of the numbers of the cells which have not yet been activated in the bingo sheet 101 is selected. In the center covering image 130, the wordings such as "BINGO NUMBER" and "REACH NUMBER" are displayed for a part of the pockets 53*a* of the large lottery ring 53A respectively. These wordings indicate that in a case that the ball 54 has entered the pocket 53*a*, the bingo is established (the state that all cells aligned in one direction have been activated); or the bingo will be established if one more cell is activated. The attribution image 132 and the wordings of the center covering image 130 move in the circumferential direction in synchronization with the rotation of the lottery ring 53. When the ball 54 enters any one of the pockets 53*a* in the single lottery game, the lottery game ends, and then the cell in the bingo sheet 101 corresponding to the number set to the pocket 53*a* which the ball 54 has entered is activated.

Figure 15:
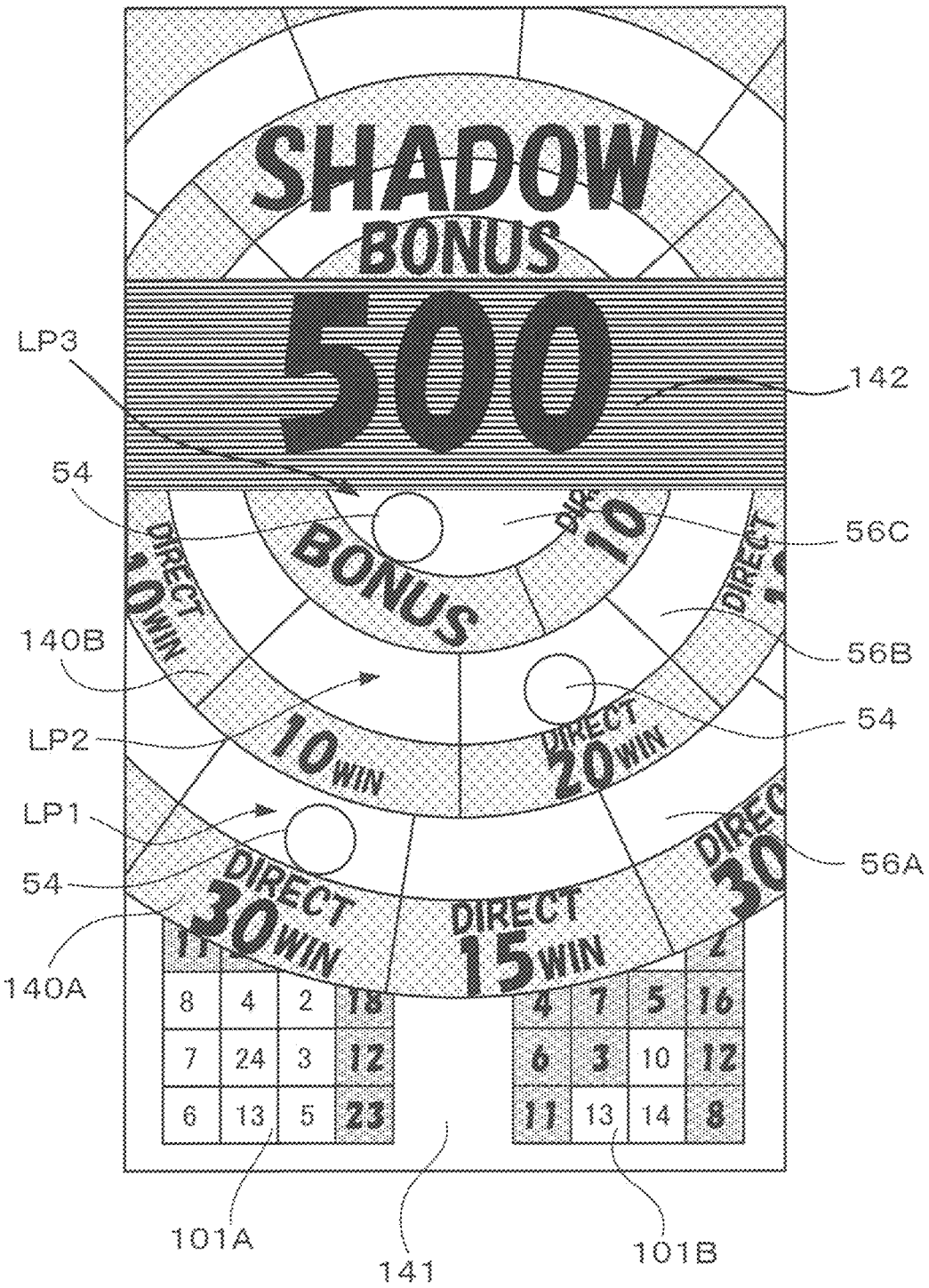
FIG. 15 is a diagram showing one example of a display state in a lottery game where a plurality of lottery portions are used in parallel.

FIG. 15 shows one embodiment of display of simultaneous type lottery game (referred to as the simultaneous lottery game in some cases) using simultaneously more than two lottery portions LP. In this example, the lottery is performed with using simultaneously the three lottery portions LP1 to LP3. The simultaneous lottery game of FIG. 15 is performed for the user playing the medal pusher game, who is set as the lottery right holder, in the following cases, for example, a medal M to which a predetermined attribution is set has dropped to the drop portion 34 in the medal pusher game; or a predetermined win has been obtained in a game provided by the subsidiary game unit 12.

In the simultaneous lottery game, at least the lower portion (the area where a ball 54 could swing) of each of the lottery passages 56 of all lottery portions LP and a ball 54 which has been inserted to the lower portion of each lottery passage 56 can be seen through the screen 51*b*, and some image is displayed on the screen 51*b* so that the visibility of the other portions of the lottery mechanism 50 is made to be lower. For example, ring-shaped attribution images 140A to 140C are displayed at regions corresponding to the side surfaces of the lottery rings 53 respectively, each ring-shaped attribution image 140A, 140B, 140C showing attribution (a wording or a numeral indicating the reward, such as the amount of medals to be dispensed) set to each pocket 53*a* of each lottery ring 53. At a region corresponding to the lower portion than the lottery passage 56A of the large lottery portion LP1, a lower part covering image 141 including the bingo sheets 101A and 101B is displayed. Besides that, appropriate image is displayed at a region corresponding to the upper portion of the lottery portions LP. By those images 140 and 141, it is possible to make the users of one of the game providing areas GA recognize certainly that there is being provided a lottery game using all of the lottery portions LP. In the simultaneous lottery game, when the ball 54 enters any one of the pockets 53*a* in each lottery ring 53, the lottery ends. And then, the total amount of rewards each of which is set to the pocket 53*a* which the ball 54 has entered is dispensed to the user as the lottery right holder. On the other hand, each lottery ring 53 has at least one pocket 53*a* to which the attribute "BONUS" is set, and if the ball 54 enters the "BONUS" pocket 53*a* in all of the lottery portions LP, specially added bonus is dispensed for the user as the lottery right holder.

Figure 16:
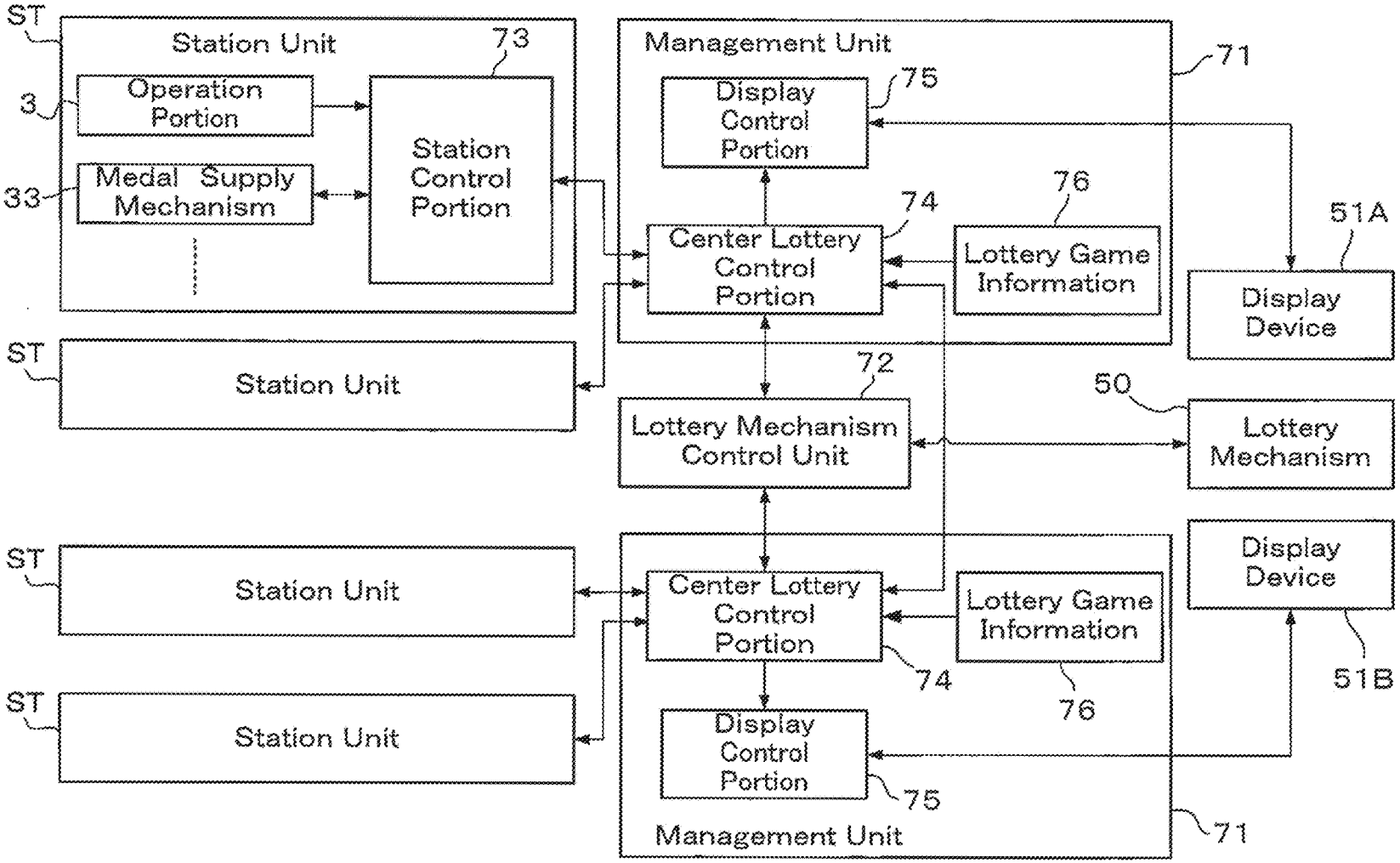
FIG. 16 is a functional block diagram with respect to main portions in a control system of the game machine.

Next, in reference to FIG. 16, a configuration of a control system for providing simultaneously above mentioned games to the two game providing areas GA respectively will be explained. As shown in FIG. 16, the game machine 2 comprises: the station units ST; a pair of management units 71 each being provided for each game providing area GA; and a lottery mechanism control unit 72 provided for the lottery mechanism 50 of the center game unit 11. Each station unit ST includes a station control portion 73 as a computer. The station control portion 73 executes various kinds of operational control or calculation processing which should be executed uniquely for each station unit ST. For example, the station control portion 73 is in charge of processing necessary uniquely for each station unit ST, such as the processing for controlling a medal insertion operation by the medal supply mechanism 33 in response to the operation state to the operation portion 3, the processing for reading out identification information of each medal M which has dropped down to the drop portion 34, the processing for reading out identification information recorded in the card 4 of a user to identify the user, and the proceeding for dispensing medals as a reward for a user. Although FIG. 16 shows the detail configuration of only one station unit ST, the same also applies to the other station units ST.

The management unit 71 is a computer, and is in charge of executing, in cooperation with the station control portions 73 of the two station units ST belonging to the same game providing area GA as the management unit 71, processing necessary for control of various devices which should be shared by the station units ST. For example, the management unit 71 is in charge of control of the lottery game which is provided using one display device 51A and control of display image therefor. Similarly, the management unit 71 is also in charge of control of the subsidiary game unit 12. However, the details thereof are omitted, since having no relation with the subject matter of the present invention. The lottery mechanism control unit 72 executes processing necessary for operational control of the lottery mechanism 50. For example, the lottery mechanism control unit 72 is in charge of the following processing, such as, switching between driving to rotate each lottery ring 53 and stopping thereof; control of insertion operation of a ball 54 by switching the position of the stopper 65 in the insertion mechanism 55; determining whether a ball 54 stays or not in each pocket 53*a* depending on a signal of each ball sensor 68; and identifying a pocket 53*a* which a ball 54 has entered (that is, determining which pocket 53*a* a ball 54 has entered). With respect to the position of each stopper 65, the switching control may be executed individually for each lottery portion LP, or may be executed together with all lottery portions LP so that their stoppers 65 stay at the same position. In the former case, the insertion or interruption of insertion for a ball 54 is individually controlled for each lottery portion LP, and in the later case, the insertion or interruption of insertion for a ball 54 is controlled together with all lottery portions LP.

The management unit 71 is provided with a center lottery control portion 74 and a display control portion 75, each being a logical device realized by a combination of computer hardware and software. The center lottery control portion 74 is in charge of executing, in cooperation with the lottery mechanism control unit 72, processing necessary for execution of a lottery game by the center game unit 11. For example, in a case that a condition for executing a lottery game using the lottery mechanism 50 is satisfied, the center lottery control portion 74, by reference to data 76 of lottery game information held in an appropriate storage device of the management unit 71, determines a lottery portion(s) LP which should be used for the lottery game, and provides the display control portion 75 with information necessary for drawing image according to the lottery portion(s) LP to is used. Further, the center lottery control portion 74 determines a result of the lottery game based on information of a lottery result provided from the lottery mechanism control unit 72, and determines a reward of the lottery game and the like depending on the determination result. The display control portion 75 controls depending on the kind of lottery game, image which should be displayed by the display device 51, in cooperation with the center lottery control portion 74. The examples of display image were shown in FIGS. 12 to 15. The two management units 71 shown in FIG. 16 may be configured by a single computer.

The data 76 of lottery game information includes use lottery portion information indicating which lottery portion LP is used and how the lottery portion LP is used; and attribution setting information indicating what kind of attribution should be set to each pocket 53*a* of the lottery ring 53. For example, in the use lottery portion information, as shown in FIG. 17, a game type (any one of the sequential type, the single type, or the simultaneous type) and the lottery portion(s) LP to be used are designated for each lottery game A, B, C, . . . . In a case of the sequential type, the lottery portions LP are used in the order they are written, and in a case of the simultaneous type, the written lottery portions LP are used simultaneously. On the other hand, as exemplified in FIG. 18, in the attribution setting information, for each lottery game A, B, C, . . . , it is designated what kind of attribution should be set to each pocket 53*a* in each lottery portion LP to be used. In the lottery mechanism 50, each pocket 53*a* is managed by a pocket number (#1, #2, . . . ) unique for each pocket 53*a*, and the lottery mechanism control unit 72 determines the pocket number of the pocket 53*a* which a ball 54 has entered in each lottery portion LP. In the information shown in FIG. 18, attribution which should be set to each pocket 53*a* in association with the corresponding pocket number is designated for each lottery portion LP. In the lottery game shown in FIG. 14, each attribution to be set to each pocket 53*a* is the number which has not yet been activated in the bingo sheet 101. In such a case, in the attribution setting information, information that any one of cell numbers not yet activated should be set is designated for each pocket number. The center lottery control portion 74 acquires from the station control portion 73, a cell number which should be activated, that is the number of the bingo medal M4 which has dropped down to the drop portion 34, and controls display for indicating an activated or not activated state of each cell of the bingo sheet 101. Thereby, the center lottery control unit 74 can determine a cell number which has not yet been activated, and can link the cell number with the pocket number.

Figure 19:
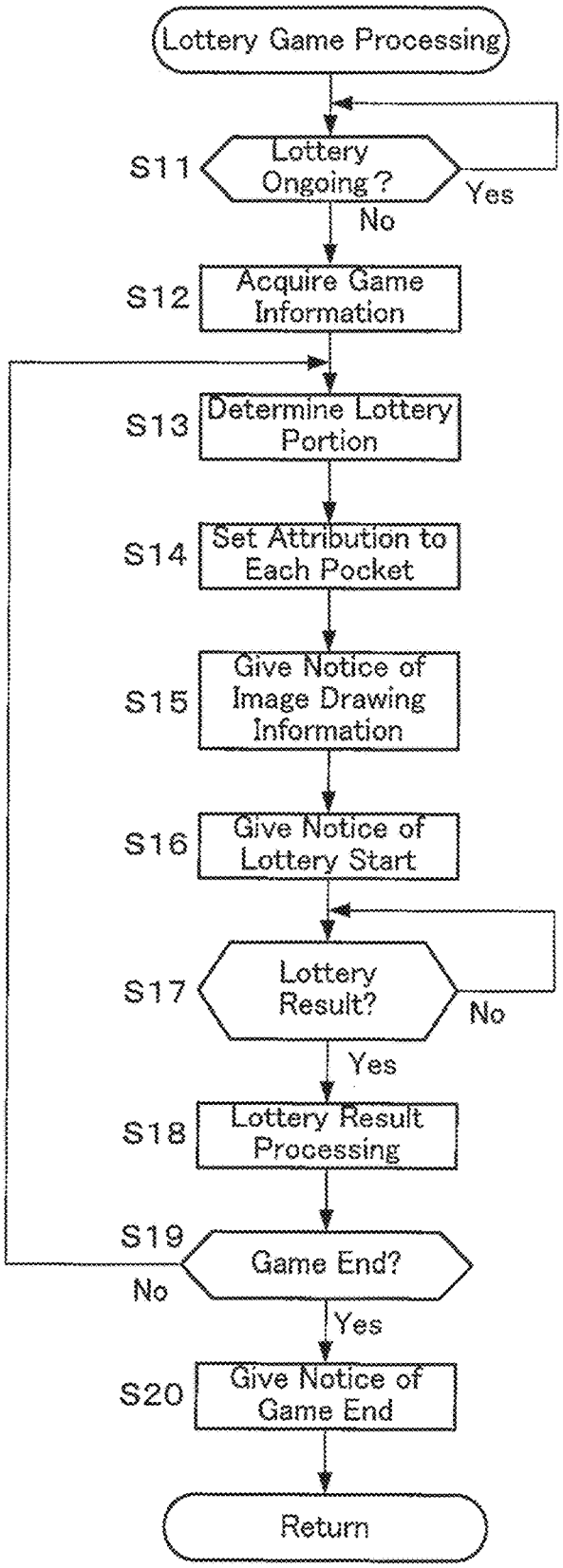
FIG. 19 is a flowchart showing procedure of lottery game processing executed by a center lottery control portion.

Next, the following will explain lottery game processing executed by the center lottery control portion 74 in reference to FIG. 19. This processing is executed in a case that a lottery start condition is established with respect to a user of any one of the station units ST of any one of game providing areas GA. When the lottery game processing of FIG. 19 starts, the center lottery control portion 74, first, inquires to the lottery mechanism control unit 72 whether there is any ongoing lottery or not, that is, whether any lottery portion LP is in middle of lottery performance just after a ball 54 has entered. In a case that the lottery portion is in middle of lottery performance, the center lottery control portion 74 waits until the lottery ends (step S11). After the lottery ends, the center lottery control portion 74 acquires from the data 76, information of a lottery game to be performed this time (step S12). Here, the information acquired from the data 76 includes the following information, such as, the type of the lottery game to be performed, the lottery portion(s) LP to be used, and attribution to be set to each pocket 53*a*.

Next, the center lottery control unit 74 determines the lottery portion(s) LP to be used (step S13) and sets attribution to each pocket 53*a* based on the information acquired at step S12 (step S14). This setting is executed by storing data where the lottery portion LP, the pocket number, and the attribution are linked with each other in an appropriate provisional storage memory of the management unit 71. As shown in FIG. 14, in a case that a lottery game where the attribution of pocket 53*a* is variable is preformed, information necessary for setting the attribution (for example, the cell numbers not yet activated in the bingo sheet 101) is acquired at step S14, and the attribution is set to in association with the lottery portion LP and the pocket number. Subsequently, the center lottery control portion 74 notifies the display control portion 75 of information necessary for drawing image which should be displayed on the display device 51 (step S15). For example, information designating which lottery game's image should be drawn, information designating a lottery portion LP whose visibility should decrease by superposing image thereon, information designating attribution set to each pocket 53*a*, and the like are notified to the display control portion 75. After receiving the notice, the display control portion 75 displays an image according to the lottery game, like the exemplified image in each of FIGS. 12 to 15, on the screen 51*b* of the display device 51.

Subsequently, the center lottery control portion 74 notifies the lottery mechanism control unit 72 and the other center lottery control portion 74 of the lottery start (step S16). By this notice, each of the pair of center lottery control portions 74 can notice that the lottery start has been issued at the other center lottery control portion 74 as a counterpart of the pair. When receiving the notice, the center lottery control portion 74 may determine that a lottery condition for any one of lottery games has been satisfied and start the processing of FIG. 19. For example, in response to a start notice of the lottery game of FIG. 12, the center lottery control portion 74 as the counterpart may start the processing of FIG. 19 so that the lottery game of FIG. 14 is provided to the game providing area GA which the center lottery control portion 74 as the counter itself belongs to.

When receiving the notice of step S16, the lottery mechanism control unit 72 waits for an issue of lottery start from the center lottery control portion 74 as the counterpart for a certain period. If the lottery start has been issued, or the certain period has elapsed, the lottery mechanism control unit 72 controls the lottery mechanism 50 to start a lottery. In a case that the lottery start is also issued from the center lottery control unit 74 as the counterpart, in the center game unit 11, lottery games different from each other but using the common lottery mechanism 50 are provided to the game providing areas GA1 and GA2 respectively. The reason why the control unit 72 waits for a certain period is that, since the lottery by the lottery mechanism 50 requires a certain time, it is preferable to provide simultaneously lottery games to the game providing areas GA as much as possible. Further, in a case that the lottery is performed in the lottery mechanism 50, balls 54 may be inserted to all of the lottery portions LP respectively, or a ball 54 may be limitedly inserted to the lottery portion LP to be used in the lottery game. For example, in a case that the large lottery portion LP1 is used for one game providing area GA, and the middle lottery portion LP2 is used for the other game providing area GA, even if balls 54 are inserted to all lottery portions LP respectively, a lottery state of the small lottery portion LP3 is interrupted by images of the display devices 51 located on both sides, thereby the lottery state becomes hard to be recognized by users on both sides. On the other hand, in the above case, if balls 54 are inserted to the large and middle lottery portions LP1 and LP2 respectively, and no ball 54 is inserted to the small lottery portion LP3, the lottery state of the middle lottery portion LP2 which is not used for a first lottery game may be interrupted by a first image on a first display device 51, and the lottery state of the large lottery portion LP1 which is not used for a second lottery game may be interrupted by a second image on a second display device 51. Since no lottery is performed in the lottery portion LP3, it is not necessary to superpose image thereon.

After issuing the lottery start, the center lottery control portion 74 waits for a lottery result notified from the lottery mechanism control unit 72 (step S17). When the pocket number which the ball 54 has entered at the lottery portion LP which is used for the lottery game is notified as the lottery result from the lottery mechanism control unit 72, the center lottery control portion 74 executes the processing depending on the attribution set to the pocket number (step S18). For example, in a case that the amount or the sum for the reward is set as the attribution, the processing for dispensing the reword to the user is executed. In the example of FIG. 12, when the ball 54 has entered the pocket 53*a* to which the attribute "NEXT" is set, a dramatic performance or the like for progressing to the second stage of the lottery game is executed. Next, the center lottery control portion 74 determines whether the lottery game is allowed to end or not by the processing of step S18 (step S19). In the sequential type lottery game, if the lottery result for allowing to progress to the next stage has been obtained, it is not determined that the lottery game is allowed to end. In the single type, or simultaneous type lottery game, it is determined that the lottery game is allowed to end for one time lottery.

In a case that it is not determined that the lottery game is allowed to end, the center lottery control portion 74 returns to step S13. In this case, the lottery game is made to progress to the next stage in the sequential type lottery game. On the other hand, in a case that it is determined that the lottery game is allowed to end, the center lottery control portion 74 notifies the lottery mechanism control unit 72 and the center lottery control portion 74 as the counterpart of the lottery end, and ends the processing for the current lottery game (step S20). The above processing is executed by each of the management units 71, thereby it is possible to preform simultaneously lottery games different from each other so as to differ in the lottery portion(s) LP to be used between the first game providing area GA1 and the second game providing area GA2, and also it is possible to display image for each game providing area GA in such a way that the visibility of the lottery portion LP not being used for the game is made to be relatively lower than that of the lottery portion LP being used for the lottery game.

The present invention is not limited to the above embodiments, and various changes or modifications are possible to be applied. For example, the configuration of the lottery mechanism is not limited to the illustrated example. As long as one lottery result is obtainable from physical motion of a game medium, the lottery mechanism may be configured as appropriate. As the game medium, not only a ball is employed, but also an appropriate shaped, such as a disc-shaped, object may be employed. In a case that a plurality of lottery portions are provided, the number of lottery portions is not limited to 3, and the number may be two, or four or more. Further, even in a case that only a single lottery portion is provided, the present invention is possible to be applied to this case. In this case, while each transmission region of the image display device is set so that a lottery state of the lottery portion is observed at each of the plurality of game providing areas, image indicating attribution of each choice of the lottery and other image are made to differ between the game providing areas, thereby it is possible to provide games different from each other between the game providing areas. The transmission region which should be set on a screen of an image display device is not limited to the above example that is realized by setting a region where image is not displayed on a screen having transmissivity, such as glass substrate. By forming a hole or the like at a certain part in a screen, the part may be provided in the screen as a constant transmission region. As a typical embodiment, in a case that a single lottery portion is provided, the transmission region may be provided by forming the hole at a part where the lottery state should be observed. A single curved display device may be arranged at the outer circumference of a physical lottery mechanism, and a plurality of logical image display devices may be provided by making the display device display each image different from each other for each of a plurality of game providing areas located around the lottery mechanism in a different direction from each other.

In the above embodiments, the management unit 71 provided for each game providing area includes the center lottery control portion 74 as a game control device and the display control portion 75 as a display control device. However, the proceeding of FIG. 19 may be executed by the lottery mechanism control unit 72. Or, the proceeding of FIG. 19 may be executed by the station control portion 73. In this way, an appropriate computer may be made to function as the game control device and the display control device.

The game machine of the present invention in not limited to a medal game machine, and is possible to be configured as a casino gaming machine. As long as a lottery mechanism can be shared by the plurality of game providing regions, the game machine is allowed to be configured as appropriate. With respect to the game contents which should be executed in association with a lottery of a lottery mechanism, as long as the game progress or the game result is settled in association with the lottery result by the lottery mechanism itself, any game contents may be employed as appropriate. In the above embodiment, a single game providing area allows a plurality of users to play games there. However, the relation between the game providing area and the number of users who are allowed to play games in a range of the game providing area is not limited to this embodiment. The present invention may be applied to an embodiment that a single game providing area allows a single user to play games there.

The following describes various aspects of the present invention which are derived from the above embodiments and variations.

A game machine as one aspect of the present invention is a game machine comprising: a lottery mechanism having has at least one lottery portion in which a lottery is performed using physical motion of a game medium, the lottery mechanism being provided so that a state of the lottery is observed from each of a plurality of game providing areas, a plurality of image display devices, each of the plurality of image display devices including a screen which is arranged between each of the plurality of game providing areas and the lottery mechanism and has a transmission region through which the at least one lottery portion is seen; and being allowed to display image on the screen so that the image is superposed on at least a part of the at least one lottery portion, a game control device which is programmed to execute simultaneously games in association with the lottery with respect to the plurality of the game providing areas respectively, the game being different from each other; and a display control device which is programmed to make each of the image display devices display image appropriate to the game to be executed with respect to each of the game providing areas.

According to the above aspect of the game machine, while the lottery state is allowed to be observed through the transmission region of the screen of each image display device, some image is displayed so as to be superposed on at least a part of the lottery portion. Thereby, the visibility of a part or all over of the lottery portion located behind the image is made to be lower.

In the above game machine, the lottery mechanism may be provided with a plurality of lottery portions each of which the lottery is performed in, the image display device may be provided so that each of the plurality of lottery portions is seen through the transmission region of the screen and also the image is displayed in a state of being superposed selectively on the plurality of lottery portions, the game control device may be programmed to execute the games different from each other in such a way that a difference is made between a first lottery portion which is used for a first game to be executed with respect to a first game providing area and a second lottery portion which is used for a second game to be executed with respect to a second game providing area, and the display control device may be programmed to allow a lottery state of the lottery portion which is used for each of the games to be seen through the transmission region, while make each of the image display devices display the image so that visibility of a lottery state of the lottery portion which is not used for the game is made to be relatively lower than visibility of a lottery state of the lottery portion which is used for the game.

According to the above game machine, the lottery state of the lottery portion which is used for the first game for the first game providing area but is not used for the second game for the second gaming providing area is presented clearly to the first game providing area, but is less visible or invisible for the second game providing area.

Further, in the above game machine, each of the plurality of lottery portions may be configured to perform the lottery by allowing the game medium to move so as to enter any one of a plurality of lottery positions provided on a predetermined move passage, the game control device may be programmed to control each game in such a way that a plurality kinds of attribution are assigned and set to the plurality of lottery positions provided in the lottery portion to be used in the game respectively, and make a result depending on the kind of attribution of the lottery position selected by the lottery, and the image display control device may be programmed to make each of the image display device display image corresponding to the attribution set to each of the plurality of lottery positions. According to this game machine, the attribute set to each lottery position is presented appropriately for each game providing area.

Further, the lottery portion may be configured to perform the lottery by allowing the game medium move along a lottery ring in which a plurality of pockets as the plurality of lottery positions are provided. In this case, when the game medium enters any one of the pockets, thereby the lottery is performed.

Further, the lottery ring may be provided rotatably around an axis extending in a horizontal direction, and the screens of the plurality of image display devices may be arranged so that the lottery ring is sandwiched between the screens in an axial direction.

Further, the lottery rings of the plurality of lottery portions may be arranged coaxially.

In the above game machine as one aspect of the present invention, the lottery mechanism may be configured to perform the lottery by allowing the game medium to move so as to enter any one of a plurality of lottery positions provided on a predetermined move passage, the game control device may be programmed to control each game in such a way that a plurality kinds of attribution are assigned and set to the plurality of lottery positions, and make a result depending on the kind of attribution of the lottery position selected by the lottery, the games to be executed simultaneously with respect to the plurality of the game providing areas may differ from each other in attribution set to each of the plurality of lottery positions, and the image display control device may be programmed to make each of the image display device display image corresponding to the attribution set to each of the plurality of lottery positions. According to this game machine, there is a difference in the attribution set to each of the plurality of lottery positions, between a first game which is executed with respect to a first game providing area and a second game which is executed with respect to a second game providing area.

Also in the above game machine, the lottery portion of the lottery mechanism, may be configured to perform the lottery by allowing the game medium move along a lottery ring in which a plurality of pockets as the plurality of lottery positions are provided. Further, the lottery ring may be provided rotatably around an axis extending in a horizontal direction, and the screens of the plurality of image display devices may be arranged so that the lottery ring is sandwiched between the screens in an axial direction.

In addition, it is possible to derive from the above mentioned embodiments and variations, invention different from the present invention. For example, the following invention of a game machine could be derived. The game machine comprising a lottery mechanism having a plurality of lottery portions, wherein the game machine further comprises: an image display device including a screen which is arranged so as to be superposed on the lottery mechanism and has a transmission region through which the plurality of lottery portions are seen and being allowed to display image on the screen so that the image is superposed on at least one of the lottery portions; a game control device which is programmed to execute selectively a plurality of games, each game being associated with at least one lottery; and a display control device which makes the image display device display image according to the game to be executed. In this case, a plurality of image display devices are not necessary. Even in a case that the lottery mechanism is observed from a fixed angle, if the image is displayed so as to be superposed selectively on the lottery portions by the image display device, it is possible to present appropriate lottery portions according to the game to a user.

Figure 7:
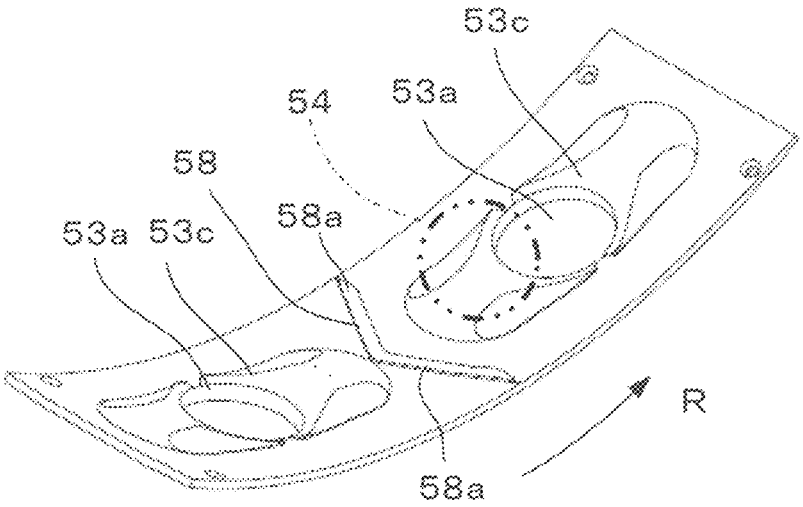
FIG. 7 is a partially enlarged view of an inner circumferential surface of the lottery ring.

Further, it is possible to derive invention corresponding to the projecting portion 58 of FIG. 7. That is, the following invention of a lottery mechanism could be derived. The lottery mechanism which is configured to perform a lottery in such a way that a game medium is inserted to an inner circumference of a lottery ring rotating around an axial line extending in a horizontal direction, and the game medium is made to enter any one of lottery positions provided on the lottery ring, wherein the width of the lottery ring with respect to the axial direction is set to be larger than the game medium, and a plurality of projecting portions are provided on the inner circumference of the lottery ring, each projecting portion being formed by a pair of projecting threads, the projecting threads extending from both side edges with respect to the width direction toward the center with respect to the width direction respectively, so as to retract backward with respect to the rotational direction. According to this projecting portion, it is possible to make the game medium move irregularly with respect to the width direction of the lottery ring. However, the pair of projecting threads are not necessary to be connected with each other. The threads may be somewhat separated from each other.

What is claimed is:

1. A game machine comprising:

a lottery mechanism having has at least one lottery portion in which a lottery is performed using physical motion of a game medium, the lottery mechanism being provided so that a state of the lottery is observed from each of a plurality of game providing areas, a plurality of image display devices, each of the plurality of image display devices including a screen which is arranged between each of the plurality of game providing areas and the lottery mechanism and has a transmission region through which the at least one lottery portion is seen; and being allowed to display image on the screen so that the image is superposed on at least a part of the at least one lottery portion, a game control device which is programmed to execute simultaneously games in association with the lottery with respect to the plurality of the game providing areas respectively, the game being different from each other; and a display control device which is programmed to make each of the image display devices display image appropriate to the game to be executed with respect to each of the game providing areas.

2. The game machine according to claim 1, wherein the lottery mechanism is provided with a plurality of lottery portions each of which the lottery is performed in, the image display device is provided so that each of the plurality of lottery portions is seen through the transmission region of the screen and also the image is displayed in a state of being superposed selectively on the plurality of lottery portions, the game control device is programmed to execute the games different from each other in such a way that a difference is made between a first lottery portion which is used for a first game to be executed with respect to a first game providing area and a second lottery portion which is used for a second game to be executed with respect to a second game providing area, and the display control device is programmed to allow a lottery state of the lottery portion which is used for each of the games to be seen through the transmission region, while make each of the image display devices display the image so that visibility of a lottery state of the lottery portion which is not used for the game is made to be relatively lower than visibility of a lottery state of the lottery portion which is used for the game.

3. The game machine according to claim 1, wherein each of the plurality of lottery portions is configured to perform the lottery by allowing the game medium to move so as to enter any one of a plurality of lottery positions provided on a predetermined move passage, the game control device is programmed to control each game in such a way that a plurality kinds of attribution are assigned and set to the plurality of lottery positions provided in the lottery portion to be used in the game respectively, and make a result depending on the kind of attribution of the lottery position selected by the lottery, and the image display control device is programmed to make each of the image display device display image corresponding to the attribution set to each of the plurality of lottery positions.

4. The game machine according to claim 3, wherein the lottery portion is configured to perform the lottery by allowing the game medium move along a lottery ring in which a plurality of pockets as the plurality of lottery positions are provided.

5. The game machine according to claim 4, wherein the lottery ring is provided rotatably around an axis extending in a horizontal direction, and the screens of the plurality of image display devices are arranged so that the lottery ring is sandwiched between the screens in an axial direction.

6. The game machine according to claim 4, wherein the lottery rings of the plurality of lottery portions are arranged coaxially.

7. The game machine according to claim 1, wherein the lottery mechanism is configured to perform the lottery by allowing the game medium to move so as to enter any one of a plurality of lottery positions provided on a predetermined move passage, the game control device is programmed to control each game in such a way that a plurality kinds of attribution are assigned and set to the plurality of lottery positions, and make a result depending on the kind of attribution of the lottery position selected by the lottery, the games to be executed simultaneously with respect to the plurality of the game providing areas differ from each other in attribution set to each of the plurality of lottery positions, and the image display control device is programmed to make each of the image display device display image corresponding to the attribution set to each of the plurality of lottery positions.

8. The game machine according to claim 7, wherein the lottery portion of the lottery mechanism is configured to perform the lottery by allowing the game medium move along a lottery ring in which a plurality of pockets as the plurality of lottery positions are provided.

9. The game machine according to claim 8, wherein the lottery ring is provided rotatably around an axis extending in a horizontal direction, and the screens of the plurality of image display devices are arranged so that the lottery ring is sandwiched between the screens in an axial direction.

* * * * *